US012446744B2

(12) United States Patent
Ichihashi et al.

(10) Patent No.: US 12,446,744 B2
(45) Date of Patent: Oct. 21, 2025

(54) VACUUM CLEANER

(71) Applicant: Koki Holdings Co., Ltd., Tokyo (JP)

(72) Inventors: Naoto Ichihashi, Ibaraki (JP); Hiroyuki Tagami, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 0 days.

(21) Appl. No.: 17/627,685

(22) PCT Filed: Jun. 26, 2020

(86) PCT No.: PCT/JP2020/025222
§ 371 (c)(1),
(2) Date: Jan. 16, 2022

(87) PCT Pub. No.: WO2021/010137
PCT Pub. Date: Jan. 21, 2021

(65) Prior Publication Data

US 2022/0240741 A1 Aug. 4, 2022

(30) Foreign Application Priority Data

Jul. 18, 2019 (JP) ..... 2019-132606

(51) Int. Cl.
*A47L 9/16* (2006.01)
*A47L 5/24* (2006.01)

(52) U.S. Cl.
CPC ..... *A47L 9/1608* (2013.01); *A47L 9/1666* (2013.01); *A47L 9/1683* (2013.01); *A47L 9/1691* (2013.01); *A47L 5/24* (2013.01)

(58) Field of Classification Search
CPC ..... A47L 5/24; A47L 5/225; A47L 9/1409; A47L 9/1608; A47L 9/165; A47L 9/1658;
(Continued)

(56) References Cited

U.S. PATENT DOCUMENTS 4,826,515 A * 5/1989 Dyson ..... A47L 9/1633 55/424
6,991,667 B2 * 1/2006 Yang ..... B04C 5/185 15/352
(Continued)

FOREIGN PATENT DOCUMENTS

CA 2593950 6/2008
CN 1706334 12/2005
(Continued)

OTHER PUBLICATIONS

JP_2016067664_Translated_Description (Year: 2016).*
(Continued)

*Primary Examiner* — David S Posigian
*Assistant Examiner* — Jacob Adam Montgomery
(74) *Attorney, Agent, or Firm* — JCIPRNET

(57) ABSTRACT

Provided is a vacuum cleaner comprising: a main body housing 10 which houses a motor and a fan and which has an intake by which an airflow created by the fan enters inside; and a dust collection unit which is attachable to and detachable from the main body housing 10 so as to cover the intake. The main body housing 10 has an attachment-receiving part 30 with a common shape such that a cyclonic dust collection unit 50 which separates fine particles using a cyclonic air flow and a dust collection unit which carries out dust collection by filtration without using centrifugal force can be interchangeably attached to and detached from the main body housing as the dust collection unit.

11 Claims, 16 Drawing Sheets

(58) Field of Classification Search
CPC .... A47L 9/1666; A47L 9/1683; A47L 9/1691; A47L 9/2884; A47L 9/322; A47L 9/14; A47L 9/16; E01H 1/08; E01H 1/08009
USPC ..... 15/347, 329, 344; 55/429
See application file for complete search history.

(56) References Cited

U.S. PATENT DOCUMENTS

| | | | | |
|---|---|---|---|---|
| 2002/0069627 | A1* | 6/2002 | Park | B01D 46/88 55/498 |
| 2004/0034962 | A1* | 2/2004 | Thur | A47L 9/127 15/353 |
| 2007/0163075 | A1* | 7/2007 | Butler | A47L 9/04 15/350 |
| 2008/0196195 | A1* | 8/2008 | Conrad | A47L 9/1683 15/300.1 |
| 2013/0232724 | A1* | 9/2013 | Krebs | A47L 9/14 15/353 |

FOREIGN PATENT DOCUMENTS

| | | | | |
|---|---|---|---|---|
| CN | 101036570 | | | 9/2007 |
| CN | 202604721 | | | 12/2012 |
| CN | 103300791 | | | 9/2013 |
| CN | 105919515 | | | 9/2016 |
| CN | 107744366 | | | 3/2018 |
| JP | 2006043203 | | | 2/2006 |
| JP | 2006068040 | | | 3/2006 |
| JP | 2014068749 | A | * | 4/2014 |
| JP | 2016067664 | | | 5/2016 |
| JP | 2016067664 | A | * | 5/2016 |
| JP | 2016129564 | A | * | 7/2016 |
| JP | 2019097872 | | | 6/2019 |
| KR | 20130137580 | | | 12/2013 |
| WO | 2019065085 | | | 4/2019 |

OTHER PUBLICATIONS

JP-2016129564_Translation (Year: 2016).*
JP-2016067664_Translation (Year: 2016).*
JP-2014068749_translation (Year: 2014).*
"Office Action of China Counterpart Application" with English translation thereof, issued on Jul. 4, 2022, p. 1-p. 16.
"International Search Report (Form PCT/ISA/210) of PCT/JP2020/025222", mailed on Sep. 15, 2020, with English translation thereof, pp. 1-4.
"Search Report of Europe Counterpart Application", issued on Dec. 20, 2022, pp. 1-5.
"Office Action of China Counterpart Application", issued on Jun. 17, 2025, with English translation thereof, p. 1-p. 20.

* cited by examiner

VACUUM CLEANER

CROSS-REFERENCE TO RELATED APPLICATION

This application is a 371 application of the International PCT application serial no. PCT/JP2020/025222, filed on Jun. 26, 2020, which claims the priority benefits of Japan Patent Application No. 2019-132606, filed on Jul. 18, 2019. The entirety of each of the above-mentioned patent applications is hereby incorporated by reference herein and made a part of this specification.

TECHNICAL FIELD

The present invention relates to a small portable vacuum cleaner to which a plurality of dust collection units can be detachably attached.

BACKGROUND ART

Small cordless-type vacuum cleaners using a battery pack are widely used. A conventional compact and lightweight handy vacuum cleaner is described in, for example, Patent Literature 1, in which the entire housing is formed in a cylindrical shape, a dust case having an opening (suction port) is attached to one side on a center line (axis) in a longitudinal direction of the cylindrical shape, and a main body housing having a handle part and housing a motor and a fan is attached on the opposite side in the longitudinal direction. A paper pack type filter, a cylindrical filter extending in an axial direction, or the like is provided inside the dust case, and dust that has entered the dust case due to a suction force of the fan is collected by the filter. The dust case is fixed to the main body housing by an attachment/detachment mechanism. As an example of the attachment/detachment mechanism, there is one in which a dust case is attached to the main body housing by rotating the dust case by a certain rotation angle in a circumferential direction with respect to the axis, for example, about 120 degrees.

On the other hand, in small vacuum cleaners, a so-called cyclone type vacuum cleaner in which air mixed with dust from an intake port is suctioned toward a tangential direction from an outer circumferential side of a cyclone chamber in a cylindrical shape by an airflow generated by rotation of the motor and dust contained in the air is centrifugally separated by a strong swirling flow formed in the cyclone chamber has spread. A cyclone type vacuum cleaner includes a dust case having a columnar internal space (cyclone space) attached at a distal end of the main body housing. Air mixed with dust is suctioned into the dust case from an opening (suction port), the suctioned air is made into a circumferential swirling flow in the columnar space, and dust and air are separated by a centrifugal force generated by the swirling flow. The suctioned dust collides with an inner side of an outer wall of the dust case due to the swirling flow, falls along an inner surface of the outer wall, and moves to a bottom portion of the outer cylinder. Air separated from dust in the vicinity of an axial center of the cyclone chamber is discharged in an axial direction through an exhaust duct (inner duct), thereby enabling continuous dust collection due to a centrifugal force. The technology of Patent Literature 2 is known as such a cyclone type vacuum cleaner. In Patent Literature 2, suctioned air is guided into a cyclone chamber in a tangential direction and generates a tornado-like swirling flow in the cyclone chamber. The cyclone chamber includes an exhaust pipe provided to allow the outside and inside in an axial direction to communicate, and air is suctioned from an opening provided in a part of an outer circumferential surface of the exhaust pipe.

CITATION LIST

Patent Literature

[Patent Literature 1]
Japanese Patent Laid-Open No. 2016-67664
[Patent Literature 2]
PCT International Publication No. WO 2019/065085

SUMMARY OF INVENTION

Technical Problem

While the conventional dust case type small vacuum cleaner has an advantage of being lightweight and having a simple structure, since dust accumulates on an outer circumference of the filter, the filter is likely to become clogged as work is continued in a dusty environment. Also, when dust is thrown away, dust adhered on a surface of the filter must be removed, and thus there is a disadvantage in that the work causes inconvenience. In order to eliminate these disadvantages, there was a demand to realize a configuration in which a cyclone unit of a separate body type is added to the conventional dust case type small vacuum cleaner, but when a cyclone unit is provided at a distal end of the conventional dust case type small vacuum cleaner, the product becomes large and the overall weight increases, and this impairs portability and workability.

The present invention has been made in view of the above-described background, and an objective of the present invention is to provide a portable vacuum cleaner capable of appropriately using a conventional vacuum cleaner that suctions with a filter and a cyclone type vacuum cleaner according to a work type. Another objective of the present invention is to provide a portable vacuum cleaner having an attachment part to which a plurality of dust collection units can be selectively attached.

Solution to Problem

Typical features of the invention disclosed in the present application will be described as follows. According to the first aspect of the present invention, a vacuum cleaner includes a motor, a fan driven by the motor, a main body housing having a cylindrical shape extending in a front-rear direction, housing the motor and the fan, and including an intake port for allowing an airflow due to the fan to enter inside, and a dust collection unit detachably attached to the main body housing to cover the intake port, in which, as the dust collection unit, (1) a first dust collection unit attachable to the main body housing to cover the intake port, including a cyclone chamber in a cylindrical shape and an inflow port which is provided on a side wall of the cyclone chamber to allow inside-outside communication and configured to direct an airflow entering the inside of the cyclone chamber in a circumferential direction with a central axis of the cyclone chamber as a center, and centrifugally separating dust by rotating the airflow in the circumferential direction in the cyclone chamber, and (2) a second dust collection unit including a suction port for suctioning air mixed with dust and a dust collecting chamber in a cylindrical shape extending in a front-rear direction from the suction port to the intake port, and configured to collect dust without using a centrifugal force of the airflow, due to a filter disposed on a way in which the airflow flows in the dust collecting chamber, are selectively attachable to and detachable from the main body housing. An attached part allowing any of the first and second dust collection units to be attached in a same attachment/detachment operation is provided around the intake port of the main body housing, an attachment part attachable to the attached part is formed in the first and second dust collection units, and the attachment parts of the first and second dust collection units respectively have a common shape.

According to another aspect of the present invention, the first and second dust collection units are each attachable and detachable through rotation relative to the main body housing. The first dust collection unit is of a cyclone type and is configured to include a dust case forming the cyclone chamber and a filter attached to the dust case, the dust case includes a connection pipe in which the inflow port is provided, and air mixed with dust taken into the inside of the cyclone chamber from the connection pipe is rotated in the cyclone chamber. Also, in the first dust collection unit, a central axis B1 of the cyclone chamber in the cylindrical shape is offset in a radial direction of a rotational operation in an attachment/detachment operation, and the connection pipe is disposed on a side opposite to the central axis B1 of the cyclone chamber with respect to the central axis A1.

According to still another aspect of the present invention, the dust case of the first dust collection unit is integrally formed of a synthetic resin, and the connection pipe is formed to protrude radially outward from a rotation range of the attached part in the rotational operation. Also, the filter of the first dust collection unit is positioned to cover the intake port of the main body housing, the filter and the dust case each include a restriction means which makes rotation relative to each other impossible at a time of being attached to the main body housing, and a cylindrical protruding part from the intake port to a side of the main body housing is provided in the filter. With such a configuration, in the first dust collection unit, the filter is able to be removed from the main body housing at the same time by the attachment/detachment operation of the dust case.

According to yet another aspect of the present invention, the second dust collection unit includes a dust case having the suction port, housing the filter, and accumulating dust, and is configured as a conventional filtration type in which dust taken into the dust collection unit from the suction port is filtered only by the filter. The filter used here may be a netlike filter or the like that does not require frequent replacement or may be a paper pack type premised on frequent replacement.

Advantageous Effects of Invention

According to the present invention, since the cyclone type dust collection unit can be attached to the main body housing of the vacuum cleaner, the user can use a conventional vacuum cleaner and a cyclone type vacuum cleaner appropriately according to a work type. Particularly, users who own a conventional vacuum cleaner may purchase an additional cyclone type dust collection unit and easily switch to a cyclone type vacuum cleaner. Also, since both the dust collection units are attached to the main body housing in the same attachment method, a vacuum cleaner that is easy for users to use can be realized. Further, in realizing a cyclone type, the dust collection unit itself is configured to be replaced as a cyclone dust collection unit from a filter filtration type dust collection unit instead of inserting a cyclone dust collection unit of a separate body type into a conventional dust case type vacuum cleaner, and thereby a compact and lightweight cyclone type vacuum cleaner can be realized.

DESCRIPTION OF EMBODIMENTS

Example 1

Figure 1:
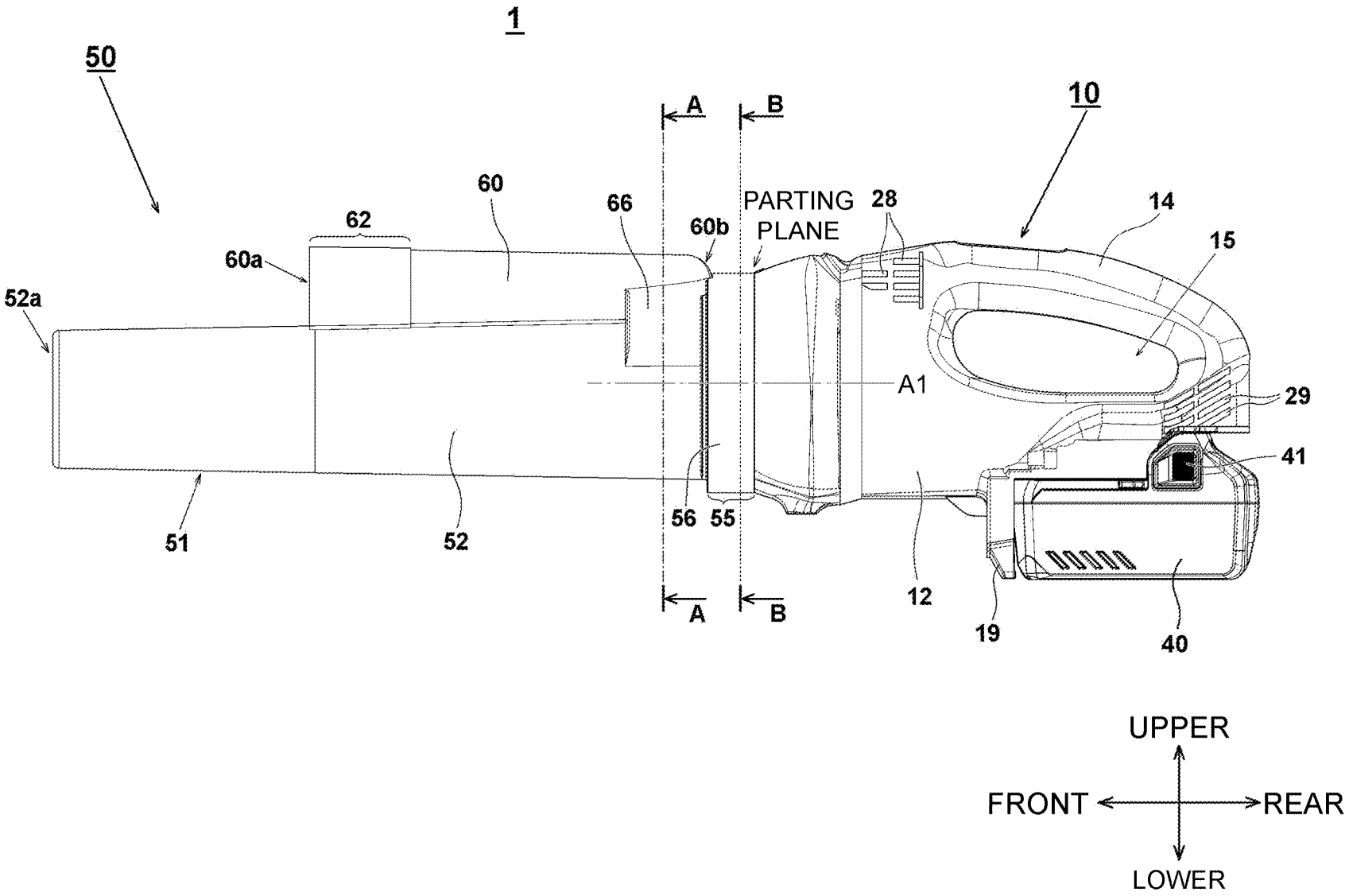
FIG. 1 is a side view of a cyclone vacuum cleaner 1 according to an example of the present invention.

Hereinafter, examples of the present invention will be described on the basis of the drawings. In the following figures, the same portions will be denoted by the same reference signs, and repeated description will be omitted. Also, in the present specification, a front-rear direction, a left-right direction, and a vertical direction will be used in description as the directions illustrated in the drawings.

FIG. 1 is a side view of a cyclone vacuum cleaner 1 according to an example of the present invention. The cyclone vacuum cleaner 1 is constituted by a main body housing 10, a cyclone unit 50, and a battery pack 40. The cyclone unit 50 can be attached to or removed from the main body housing 10. The main body housing 10 houses a motor and a fan, to be described later, therein and includes a handle part 14 formed to be suitable for an operator to grip with one hand. A hollow portion 15 for an operator to put his/her hand is formed on a lower side of the handle part 14 of the main body housing 10. In the present example, a shape of the main body housing 10 is arbitrary except for a shape of an attachment mechanism of the cyclone unit 50 (an attached part 30 to be described later in FIG. 5) and may be not only the shape illustrated in FIG. 1 but also any other shape as long as an operator can perform the work while holding it.

The battery pack 40 is attached to a lower side of the main body housing 10. The battery pack 40 houses a plurality of lithium-ion cells, which is a secondary battery, and battery packs widely used in electric tools or the like can be used. Here, the battery pack 40 with a rating of 18 V is utilized, but a voltage of the battery pack 40, a shape of the used secondary battery, an external shape of the battery pack 40, or the like is arbitrary. From a state illustrated in FIG. 1, the battery pack 40 can be removed from the main body housing 10 by sliding the battery pack 40 rearward with respect to the main body housing 10 while pressing latch buttons 41 positioned on the left and right. A battery pack guard 19 covering a front surface of the battery pack 40 is provided on a front side of the battery pack 40. An external charger (not illustrated) is used to charge the battery pack 40. The battery pack 40 in which charging has been completed can be attached to the main body housing 10 by sliding the battery pack 40 from the rear to the front.

The cyclone unit 50 that is configured to be detachably attached to the main body housing 10 is attached to a front side of the main body housing 10. The cyclone unit 50 includes an extension pipe (not illustrated) connected to a front side of a connection part 62, and a floor nozzle or the like is connected to a distal end of the pipe. The cyclone unit 50 suctions an airflow mixed with dust into the inside of a dust case 51 through a nozzle or an extension pipe (not illustrated) at a distal end thereof by generating a strong airflow (suction air) using a fan (to be described later in FIG. 2) housed inside the main body housing 10. Air mixed with dust is suctioned into the inside of the dust case 51 through a suction port 60*a* and is guided to the inside of a cyclone chamber (see FIG. 2 below for a reference sign thereof) in a cylindrical shape defined by an outer cylindrical part 52. A connection pipe 60 having an axis extending in a direction parallel to the outer cylindrical part 52 is formed on a lateral side (here, upper side) in a radial direction of the outer cylindrical part 52 of the dust case 51. In the connection pipe 60, one end side (front side) serves as the suction port 60*a* for connecting the extension pipe (not illustrated), and the other end side, that is, an end portion on a side opposite to the suction port 60*a* is a closed wall surface (curved part 60*b*).

The connection part 62 in which an inner diameter thereof is slightly increased in a stepped shape is formed in the vicinity of the suction port 60*a* of the connection pipe 60. An inner wall portion behind the connection pipe 60 when viewed in a longitudinal direction is formed to be curved and is connected to an inflow part 66 from the curved part. The inflow part 66 is provided on a side wall of the cyclone chamber 53 to allow the inside and outside of the cyclone chamber 53 to communicate and directs an airflow entering the inside of the cyclone chamber 53 in a circumferential direction with a central axis B1 of the cyclone chamber 53 as a center. The main body housing 10 and the cyclone unit 50 are connected to each other in a front-rear direction by a parting plane. The air suctioned from the suction port 60*a* flows through the parting plane from the cyclone unit 50 side to the main body housing 10 side and passes through the internal space of the motor housing part 12 to be discharged to the outside from a first exhaust port 28 and a second exhaust port 29 provided on both left and right sides of the main body housing.

Figure 2:
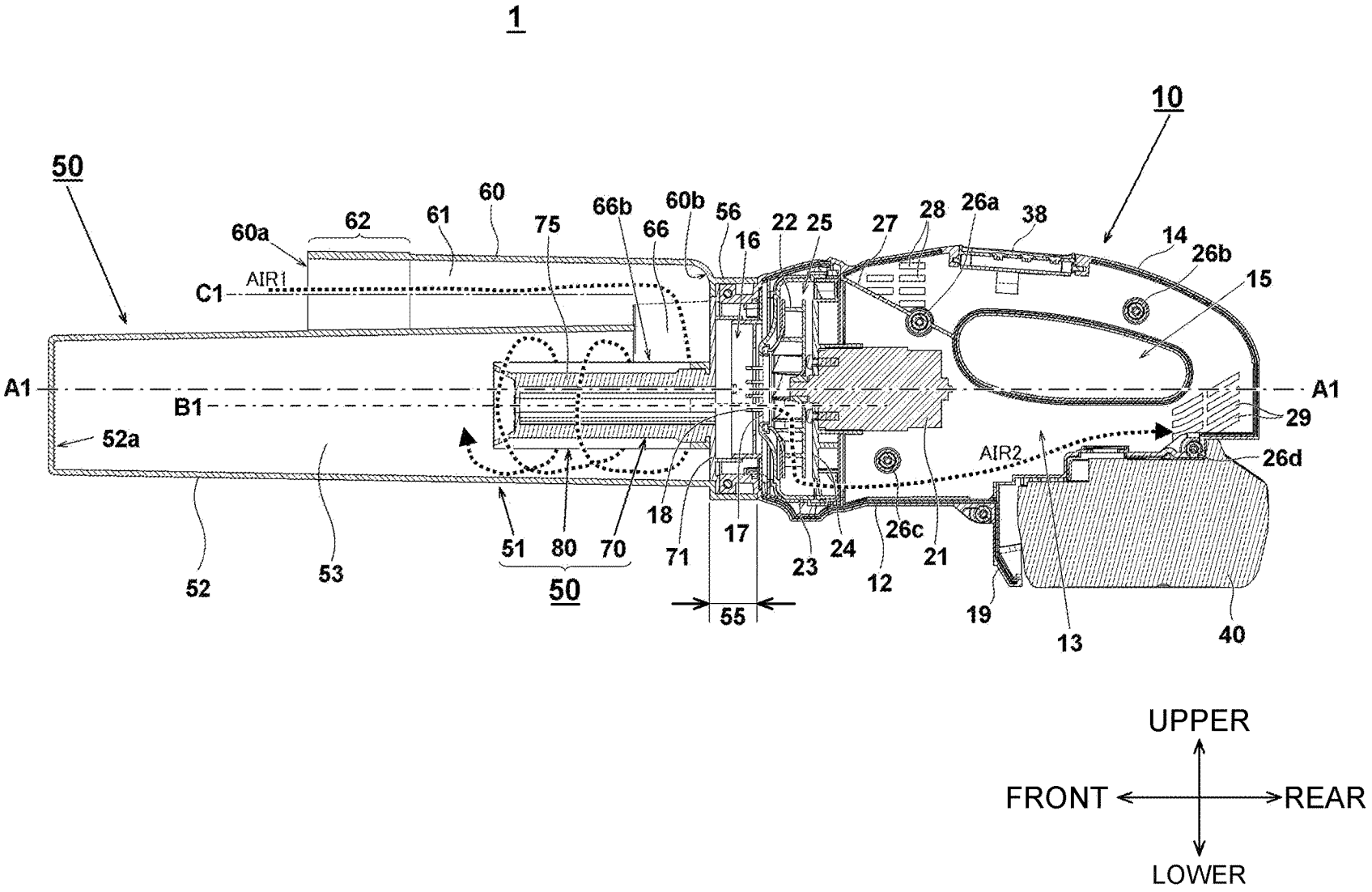
FIG. 2 is a vertical cross-sectional view of the cyclone vacuum cleaner 1 according to the present example.

FIG. 2 is a vertical cross-sectional view of the cyclone vacuum cleaner 1 according to the present example. The main body housing 10 is formed by forming a synthetic resin and has a form divided into two left and right parts with a parting plane in a vertical direction. The left and right sub-divided parts of the main body housing 10 have a plurality of screw holes (cannot be seen in the figure) and screw bosses 26*a* to 26*d* and are fixed by fixing elements such as screws (not illustrated). On the other hand, an outer shell (the dust case 51 which is an outer portion) of the cyclone unit 50 is integrally formed of a synthetic resin and has a structure that does not have a parting plane in the vertical direction. The cyclone unit 50 can be attached by being pressed rearward in a direction of an axis A1 with a position thereof aligned with respect to the main body housing 10 and then turned around the axis A1 by a predetermined angle. When the cyclone unit 50 is removed, an operation opposite to that at the time of attachment may be performed.

Air suctioned from the suction port 60*a* of the cyclone unit 50 flows rearward in an axial direction through a connection passage 61 inside the connection pipe 60 and enters the inside of a cylinder of the outer cylindrical part 52 from the inflow part 66 as indicated by a dotted arrow AIR1. A portion thereof coming close to the connection pipe 60 is connected by the inflow part 66. Inside the outer cylindrical part 52, a filter holder 70 is provided on an outer side of a cylindrical filter 80, and the air AIR1 that has flowed in is guided into the cyclone chamber 53 toward a tangential direction of the axis B1, becomes a tornado-like cyclone flow in the cyclone chamber 53, and rotates while moving toward a bottom surface 52*a*. When the tornado-like swirling flow (airflow) is generated in the cyclone chamber 53, dust suctioned together with air is centrifugally separated. The filter 80 allows air to pass from the outside to the inside in a radial direction, and dust separated by a centrifugal force due to having a higher specific gravity than air moves to the bottom surface 52*a* side of the cyclone chamber 53 and is accumulated. Here, the filter holder 70 is configured to include a filter frame 75 for holding the filter 80 and a disc-shaped closed wall 71 connected to a rear side of the filter frame 75. In the present example, a combination of the filter holder 70 and the filter 80 constitutes the "filter" in a broad sense defined in the claims. The filter holder 70 is configured to be detachably attached to the dust case 51. Air that has passed from an outer circumferential side to an inner circumferential side of the filter 80 and from the outside of the bottom surface to the inside of the bottom surface flows into an intake chamber 16 and reaches the inside of the main body housing 10 from an intake port 17.

An attachment part 55 constituted by a cylindrical part 56 and a recessed part (to be described later in FIG. 4) formed on an inner circumferential surface of the cylindrical part 56 is formed at a rear end portion of the dust case 51. The outer cylindrical part 52, the connection pipe 60, and the attachment part 55 of the dust case 51 are manufactured in an integral structure by forming a synthetic resin. In order to facilitate the integral forming, a rotation center of the attached part 30 (coincides with the axis A1) and a rotation center of the cyclone chamber 53 (a cyclone axis, the same as the axis B1 of the filter 80) have a form in which they are offset from each other. A central axis C1 of the connection pipe 60 is formed parallel to or substantially parallel to the axis B1. When the axes A1, B1, and C1 are disposed to be deviated from each other in a radial direction in this way, a strength of the dust case 51 after integral forming can be improved (a principle of this will be described later in FIG. 7).

An air passage indicated by an airflow AIR2 from the intake port 17 to the exhaust ports 28 and 29 is formed in an internal space formed by a left inner portion and a right inner portion of the main body housing 10. Here, illustration of a dotted arrow of an airflow from the vicinity of the exhaust port 29 to the vicinity of the exhaust port 28 is omitted. The hollow portion 15 which is penetrated from a left side to a right side so that four fingers of the operator from the index finger to the little finger are inserted is formed on a rear side of the main body housing 10, and the main body housing 10 appears to have a substantially D shape rotated by 90 degrees in a side view. One side (upper side) of the D-shaped hollow portion (hollow portion 15) is the handle part 14 gripped by the operator, and the remaining portion of the main body housing 10 excluding the handle part 14 is the motor housing part 12. A rear end portion of the handle part 14 and the vicinity of a rear end of the motor housing part 12 are connected, and an internal space 13 inside the motor housing part 12 and an internal space of the handle part 14 are formed to communicate with each other. Therefore, the airflow AIR2 is not all discharged from the second exhaust port 29, and air that is not discharged from the second exhaust port 29 flows forward through the internal space of the handle part 14 to be discharged to the outside from the exhaust port 28. A partition plate 27 is formed on an inner front side of the handle part 14, and the internal space of the handle part 14 and a space housing a motor 21 are separated by the partition plate 27.

The motor 21 is housed along the axis A1 of the main body housing 10. An output shaft (not illustrated) of the motor 21 is disposed in a direction along the rotation axis (attachment axis) A1 at the time of attaching the cyclone unit 50. The motor 21 is a direct current (DC) motor in which a rotor is housed in a metal motor case. Although illustration of an internal structure of the motor 21 is omitted here, the entire motor 21 is covered with a magnetic material having a substantially cylindrical shape, for example, an iron material having a thickness of 2 to 3 mm, and a case thereof also serves as a part of a stator. An outer circumferential portion in the vicinity of a front end of the motor 21 is held by a motor holder 24 having an inner cylindrical part having a cylindrical shape. The motor holder 24 is connected to the main body housing 10 at four positions on an upper side and a lower side and includes an inner cylindrical part for housing the motor 21 and a disc-shaped wall surface which is a front surface of the inner cylindrical part, and a plurality of ribs extending radially is formed between the wall surface and an outer cylindrical part to form openings communicating in the axial direction between the ribs. A fan guide 23 is disposed in front of the fan 22. A space defined by the fan guide 23 and the motor holder 24 is a fan housing chamber 25. The intake port 17 that opens to a front side is formed at a portion of the fan guide 23 close to the axis A1. Also, an opening guard 18 that guards against foreign matter entering the inside is formed in the intake port 17. The fan 22 is fixed to the output shaft (not illustrated) of the motor 21 and rotates with the axis A1 as a center in synchronization with rotation of the motor 21. The fan 22 is a centrifugal fan, suctions air from a front side along the axis A1, and discharges the wind to the outside in a radial direction of the fan 22.

Figure 3:
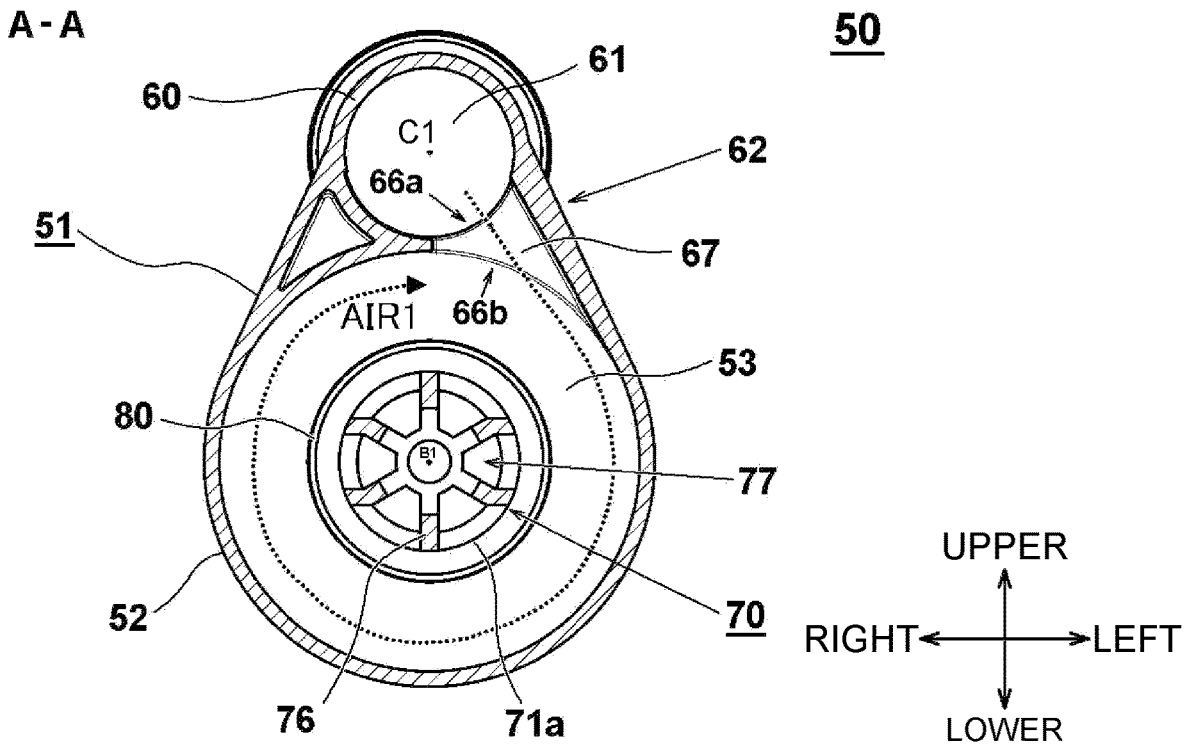
FIG. 3 is a cross-sectional view along line A-A of FIG. 1.

FIG. 3 is a cross-sectional view along A-A portion of FIG. 1. The connection pipe 60 has an inner diameter configured to match an extension pipe (not illustrated), and the outer cylindrical part 52 has an outer diameter larger than that of the connection pipe 60. The filter holder 70 for holding the filter 80 is disposed on an inner side of the outer cylindrical part 52. The filter holder 70 and the outer cylindrical part 52 are coaxially disposed with the axis B1 as a center, and a space between the filter 80 and an inner wall surface of the outer cylindrical part 52 is the cyclone chamber 53 in which the air AIR1 rotates. An inflow passage 67 is formed from a rear end portion (the curved part 60*b* in FIG. 2) of the connection pipe 60 to the cyclone chamber 53. In the inflow passage 67, a connection opening 66*a* and an inflow port 66*b* are formed only on a left half from a vertical plane passing through the axes B1 and C1, and the air AIR1 flowing from the connection pipe 60 into the cyclone chamber 53 is directed to flow in a tangential direction of the cyclone chamber 53, as a result, the air AIR1 becomes a tornado-like flow that approaches in a direction toward the bottom surface 52*a* (see FIG. 2) while swirling around the filter 80 in the cyclone chamber 53. Since the air suctioned from the connection opening 66*a* continuously flows into the inside of the cyclone chamber 53, the air correspondingly is suctioned from the outside to the inside of the filter 80, passes through an opening portion 77 from an inner space of the filter frame 75, flows to the fan 22 side along the axis B1, and flows into the intake chamber 16 (see FIG. 2) formed between the main body housing 10 and the cyclone unit 50. Although the dust case 51 is integrally formed of a synthetic resin, wall surfaces (62*a* and 62*b*) of the connection part 62 are formed to connect the connection pipe 60 and an outer circumferential surface of the outer cylindrical part 52 on an outer side of the inflow passage 67 portion, and thereby a strength of both sides is increased.

Figure 4:
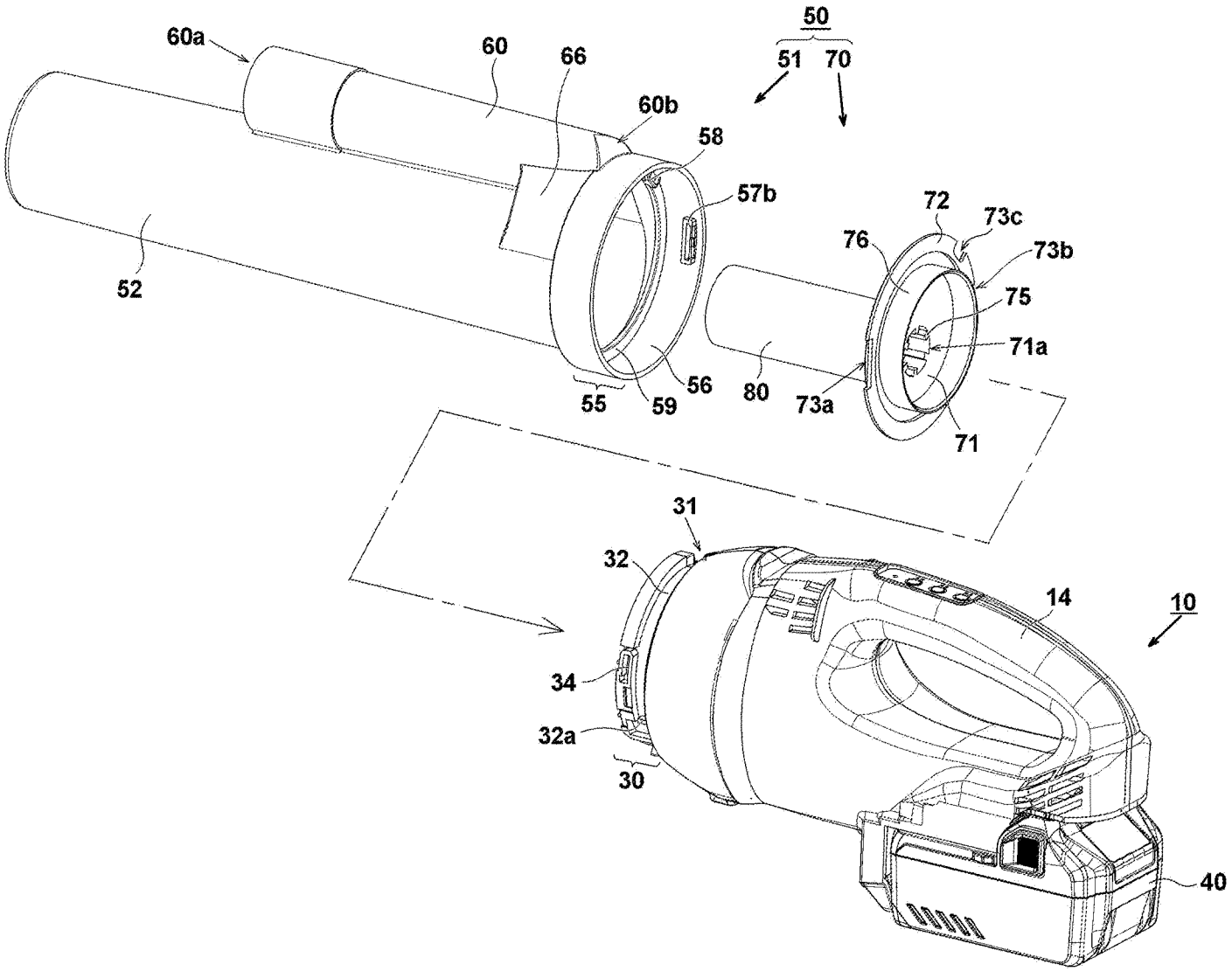
FIG. 4 is an exploded view of the cyclone vacuum cleaner 1 according to the present example with a cyclone unit 50 removed.

FIG. 4 is an exploded view of the cyclone vacuum cleaner 1 according to the present example with the cyclone unit 50 removed. The cyclone unit 50 is constituted by two main parts including the dust case 51 and the filter holder 70. The filter holder 70 is integrally formed of a synthetic resin, and the filter 80 is attached to the filter holder 70. A rear side of the dust case 51 has a circular opening, and the cylindrical attachment part 55 is formed around the opening. The attachment part 55 is a portion to be fitted with the attached part 30 of the main body housing 10, and protruding parts 57*a* and 57*b* protruding inward from an inner wall portion of the cylindrical part 56 are formed at two positions in a circumferential direction of the inner circumferential surface. Although only the protruding part 57*b* can be seen in FIG. 4, another protruding part 57*a* is provided at a position 180 degrees away in the circumferential direction. A rotation restriction protruding part 58 that restricts the filter holder 70 not to rotate relative to the dust case 51 is provided in the vicinity of the protruding part 57*b* that can be seen in FIG. 4. A position at which the rotation restriction protruding part 58 is provided is set to a position sufficiently closer to a stepped surface 59 than the two protruding parts 57*a* and 57*b* and is configured so that the rotation restriction protruding part 58 does not interfere with the attached part 30 of the main body housing 10 when the dust case 51 is attached to the main body housing 10.

The filter holder 70 is attached to the dust case 51 side after the filter 80 is attached, and the dust case 51 with the filter holder 70 attached is attached to the attached part 30 of the main body housing 10. At this time, after the protruding parts 57*a* and 57*b* of the dust case 51 are aligned to coincide with axial grooves 31 of the main body housing 10 in circumferential positions, the dust case 51 is moved to approach the main body housing 10 in a direction of the axis A1, and in that state, the dust case 51 is rotated by about 120 degrees in the circumferential direction with respect to the main body housing 10 around the axis A1. Then, the protruding parts 57*a* and 57*b* of the dust case 51 move in circumferential grooves 32 and abut against or are held at positions close to stopper surfaces 32*a*. The circumferential grooves 32 are each formed so that a width thereof in a front-rear direction gradually decreases toward the stopper surface 32*a*, and when the protruding parts 57*a* and 57*b* are in a state in which they are abutting against the stopper surfaces 32*a*, the protruding parts 57*a* and 57*b* are pressed rearward by lock members 34 and are maintained in a state of being sandwiched in the circumferential grooves 32, and thereby the dust case 51 is stably held in the main body housing 10. The lock members 34 are made of a synthetic resin. Further, a lock mechanism for stable holding when the protruding parts 57*a* and 57*b* are in contact with the lock members 34 is not limited only to a shape such as the lock members 34 that reduce the axial width of the circumferential grooves 32 but may also be realized by using a known lock mechanism or a stopper mechanism.

When the dust case 51 is removed from the main body housing 10, a reverse procedure is performed. That is, the dust case 51 is rotated about 120 degrees with respect to the main body housing 10 in a direction opposite to that at the time of the attachment with the axis A1 as a central axis, and when the protruding parts 57*a* and 57*b* reach positions that coincide with the axial grooves 31, the dust case 51 is moved in a direction of the axis A1 and in a direction away from the main body housing 10. Then, the dust case 51 is removed from the main body housing 10, but at this time, the filter holder 70 with the filter 80 attached remains in a state of being attached to the dust case 51 side. With such a configuration, the dust case 51 and the filter holder 70 can be removed from the main body housing 10 in a single operation. When the operator pulls out the filter holder 70 rearward in a direction of the axis A1 from the removed dust case 51, a space inside the outer cylindrical part 52 of the dust case 51, that is, a space in which collected dust is accumulated can be exposed. Thereafter, the operator can dispose of the collected dust inside a trash can, a trash bag, or the like by inclining the opening of the dust case 51 to face downward.

The filter holder 70 is a positioning member for attaching the cylindrical filter 80 and disposing the filter 80 at a predetermined position on the axis B1 of the cyclone chamber 53 (see FIG. 2) of the dust case. The disc-shaped closed wall 71 serving as a lid for closing the rear opening of the dust case 51 is formed in a rear portion of the filter holder 70. An annular flange part 72 that is axially shifted in a stepped shape is formed on an outer circumferential surface of the closed wall 71. When the flange part 72 comes into contact with the stepped surface 59 of the dust case 51, movement of the filter holder 70 with respect to the dust case 51 in the direction of the axis B1 and toward a side approaching the bottom surface 52*a* is restricted. The flange part 72 includes two notch parts 73*a* and 73*b* formed to avoid interference with the protruding parts 57*a* and 57*b* when the filter holder 70 is attached to the dust case 51, and one notch part 73*c* for preventing the filter holder 70 from rotating by facing the rotation restriction protruding part 58. An exhaust port 71*a* serving as an outlet for air from the cyclone unit 50 is formed in the closed wall 71. The filter frame 75 extending to the rear side is connected to an outer edge portion of the exhaust port 71*a*. Six filter frames 75 are disposed at regular intervals in the circumferential direction and extend to the front side in the direction of the axis B1 (detailed shape will be described with reference to FIG. 8).

Figure 5:
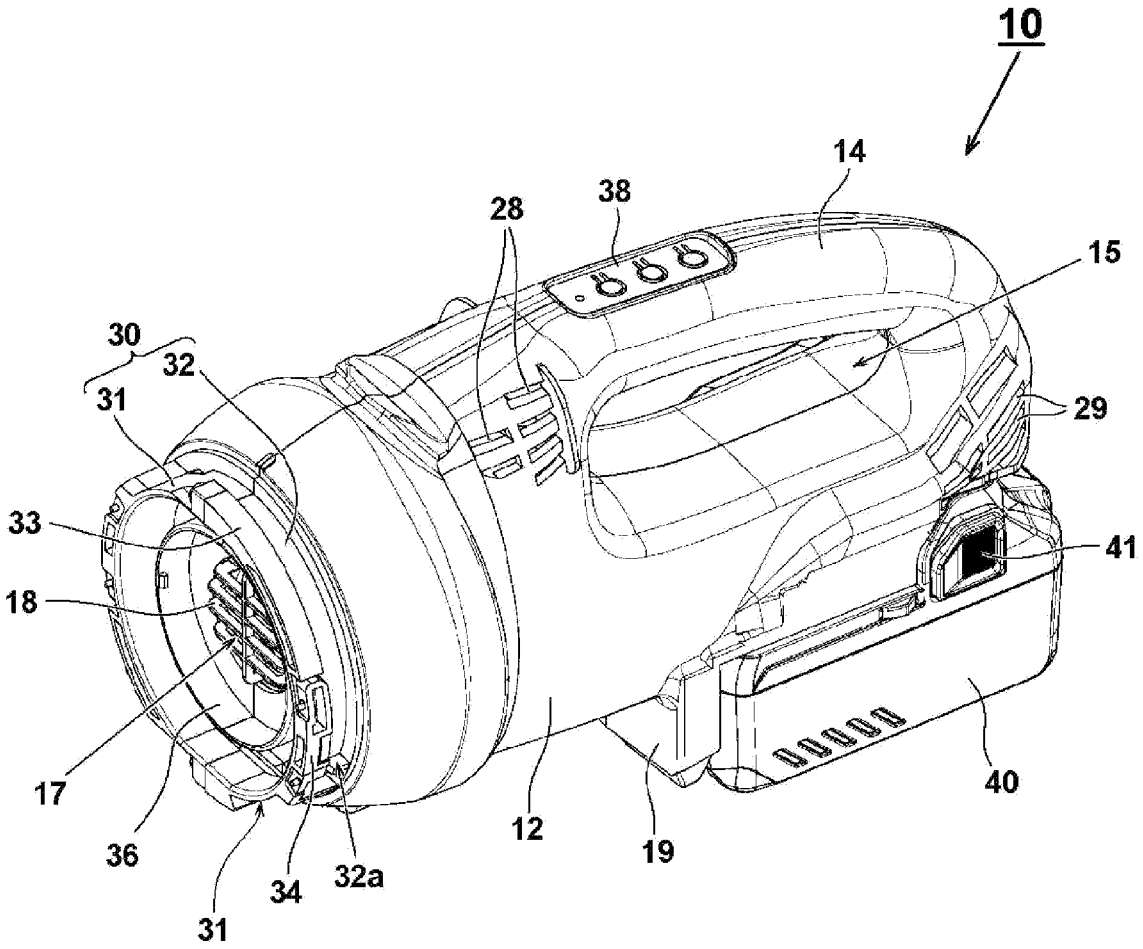
FIG. 5 is a perspective view of a main body housing 10 of the cyclone vacuum cleaner 1 according to the present example.

FIG. 5 is a perspective view of the main body housing 10. The main body housing 10 includes the handle part 14 formed on an upper side of the motor housing part 12, and a rail mechanism (not illustrated) for housing the battery pack 40 formed on a lower side. The battery pack guard 19 is formed on a front side of an attachment part of the battery pack 40 to extend downward from the motor housing part 12. The battery pack guard 19 is formed to close a ventilator window (cannot be seen in the figure) formed in the battery pack 40. A switch panel 38 on which a switch for switching on or off of the motor 21 is disposed is provided on an upper side of the handle part 14.

Figure 14:
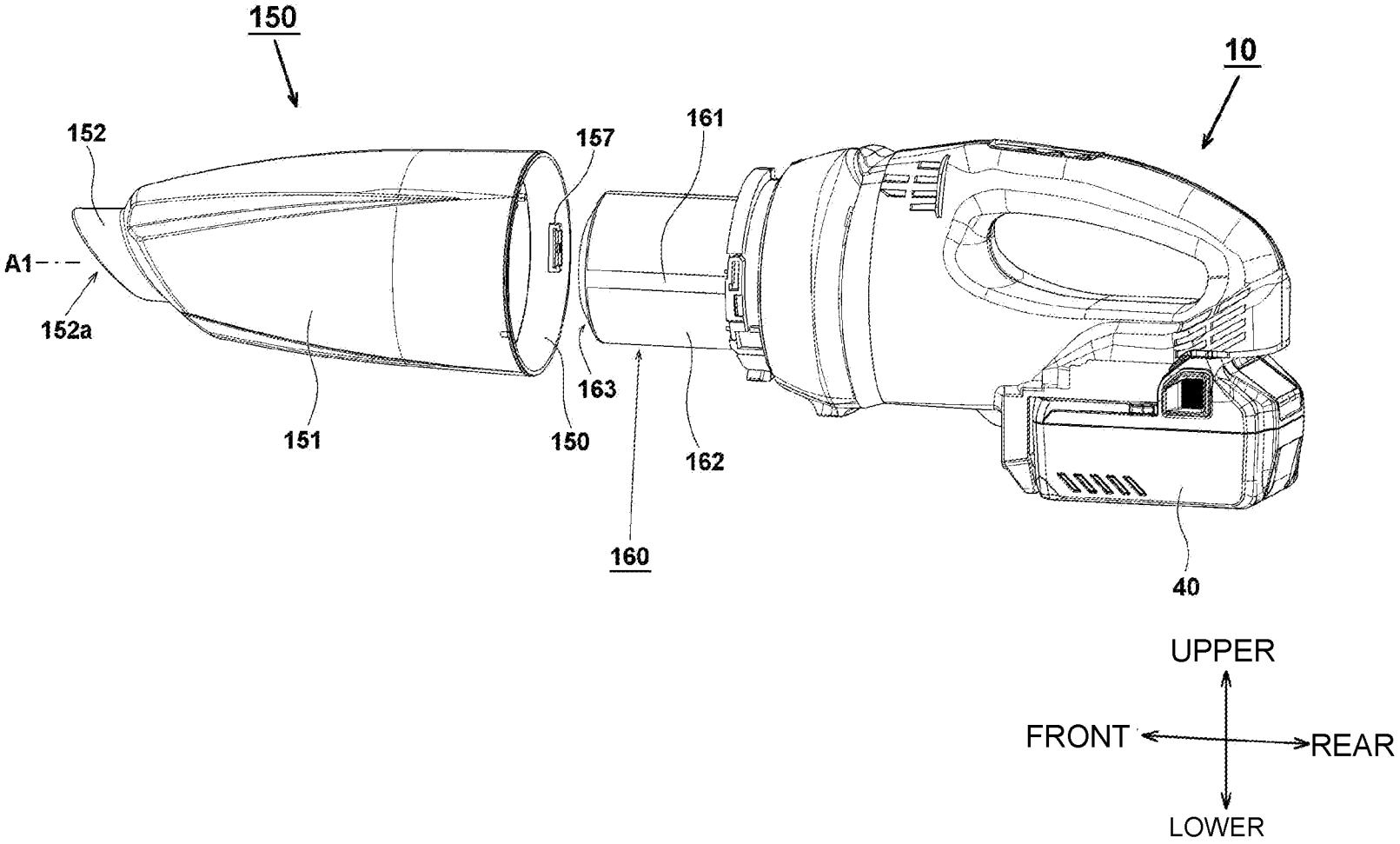
FIG. 14 is a perspective view of a filter filtration type vacuum cleaner 101 (with a dust case 151 removed).

The intake port 17 is formed on the front side of the main body housing 10 and in a central portion including the axis A1. A plurality of rib-shaped opening guards 18 extending in a horizontal direction is formed around the intake port 17. A cylindrical filter attachment part 36 is formed around the opening guards 18 at a predetermined distance in a radial direction. The filter attachment part 36 is used to attach a filter 160 (see FIG. 14) when a filter filtration type vacuum cleaner 101 to be described later in FIG. 14 is used. Further, when the cyclone unit 50 is attached to the main body housing 10, the filter attachment part 36 functions as a member for restricting the filter holder 70 not to move rearward in the axial direction.

The attached part 30 is formed on an outer circumferential surface of a front opening of the main body housing 10. The attached part 30 is configured so that both the cyclone unit 50 of the present example and a dust collection unit 150 to be described later in FIGS. 14 and 15 can be attached thereto by the same attachment/detachment operation. Here, the groove-shaped attached part 30 (the axial groove 31 and the circumferential groove 32) having a substantially L-shape in a side view is formed at two positions, and these are manufactured integrally with the main body housing 10 by integrally forming a synthetic resin. A rib 33 for holding the dust case 51 not to move in the axial direction is formed on a front side of the circumferential groove 32 in the axial direction. Also, the lock member 34 is provided adjacent to an end portion of the rib 33 in the circumferential direction. The lock member 34 has a hollow wall surface in the circumferential direction and the axial direction, and a rear wall surface of the wall surface in the circumferential direction is formed to protrude slightly rearward from the rear wall surface of the rib 33. As a result, a width of the hollow wall surface part of the lock member 34 is smaller than a width (distance in the axial direction) of the circumferential groove 32 in the vicinity of the rib 33.

Figure 6:
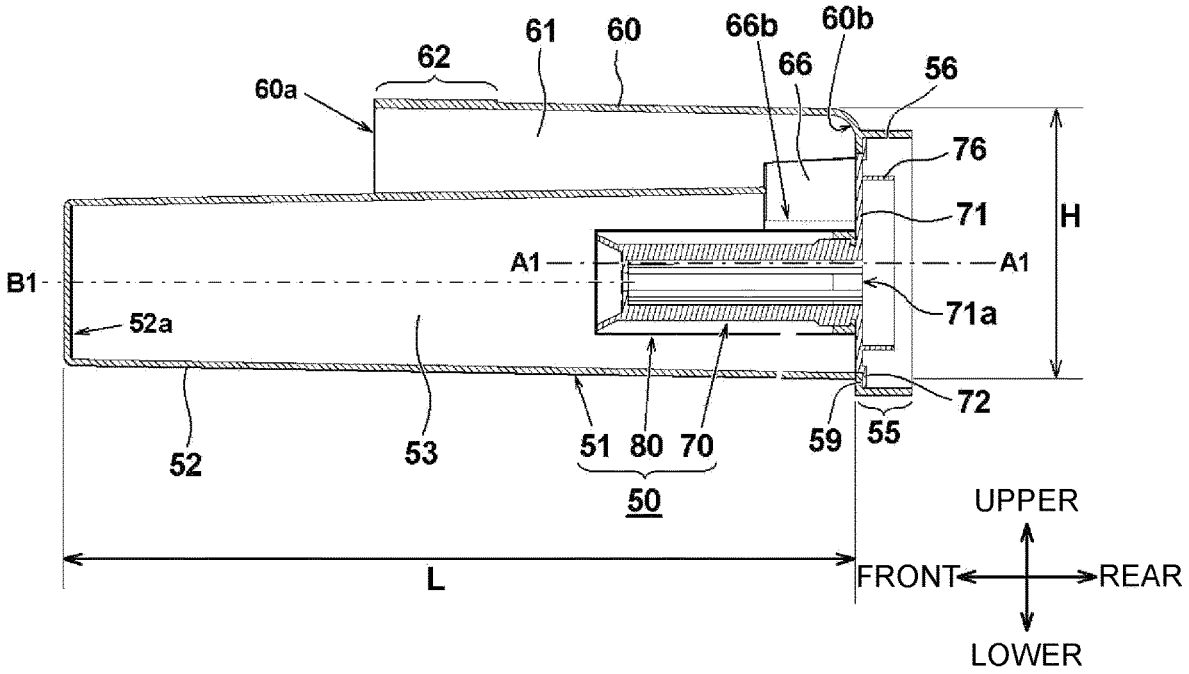
FIG. 6 is a longitudinal sectional view of the cyclone unit 50 of FIG. 1.

FIG. 6 is a longitudinal sectional view of the cyclone unit 50 of FIG. 1. The cyclone unit 50 is constituted by two parts including the dust case 51 and the filter holder 70 when the filter 80 is excluded. FIG. 6 illustrates a state in which the filter holder 70 is attached to the dust case 51. What is characteristic here is that a central axis of the cyclone chamber 53 (a space for performing cyclone-type dust separation) on a front side of the closed wall 71 and a central axis of the attachment part on a rear side (a side closer to the motor 21) of the closed wall 71 are deviated from each other. An axial center of the cyclone chamber 53 is B1, an axial center of a rotation center of the attachment part 55 on the rear side of the closed wall 71 is A1, and the axes A1 and B1 do not coincide with each other. In a conventional cyclone type vacuum cleaner, the axis B1 of the dust case 51 and the axis A1 of the rotation center of the attachment part 55 are formed to coincide with each other. However, in the present example, for a smaller size and a lighter weight, a diameter of the outer cylindrical part 52 of the dust case 51 is reduced, and the axis B1 is shifted to one side (on a lower side, here) in the radial direction with respect to the axis A1 so that a part of the connection pipe 60 is disposed in a space on the other side (on an upper side, here) in the radial direction secured by the shifting. As a result, a height H of the dust case 51 in a vertical direction can be made substantially the same as that of the filter filtration type vacuum cleaner 101 to be described later in FIG. 14. On the other hand, in order to secure a volume of the internal space of the outer cylindrical part 52 of the dust case 51, a length L thereof in the direction of the axis B1 is made sufficiently larger than a length of the filter 80 in the direction of the axis B1. As a result, a large amount of centrifugally separated dust can be accumulated in the vicinity of the bottom surface 52*a*.

Double cylindrical parts (56 and 76) are formed on the rear side (on a side closer to the motor 21) of the closed wall 71. The cylindrical part 56 is positioned on an outer circumferential surface of the attached part 30 of the main body housing 10. The cylindrical part 76 on the inner circumferential side engages with an outer circumferential surface of the filter attachment part 36 of the main body housing 10, and thereby the intake chamber 16 (see FIG. 2 for a reference sign thereof) is formed between the cylindrical part 76 and the filter attachment part 36.

Figure 7:
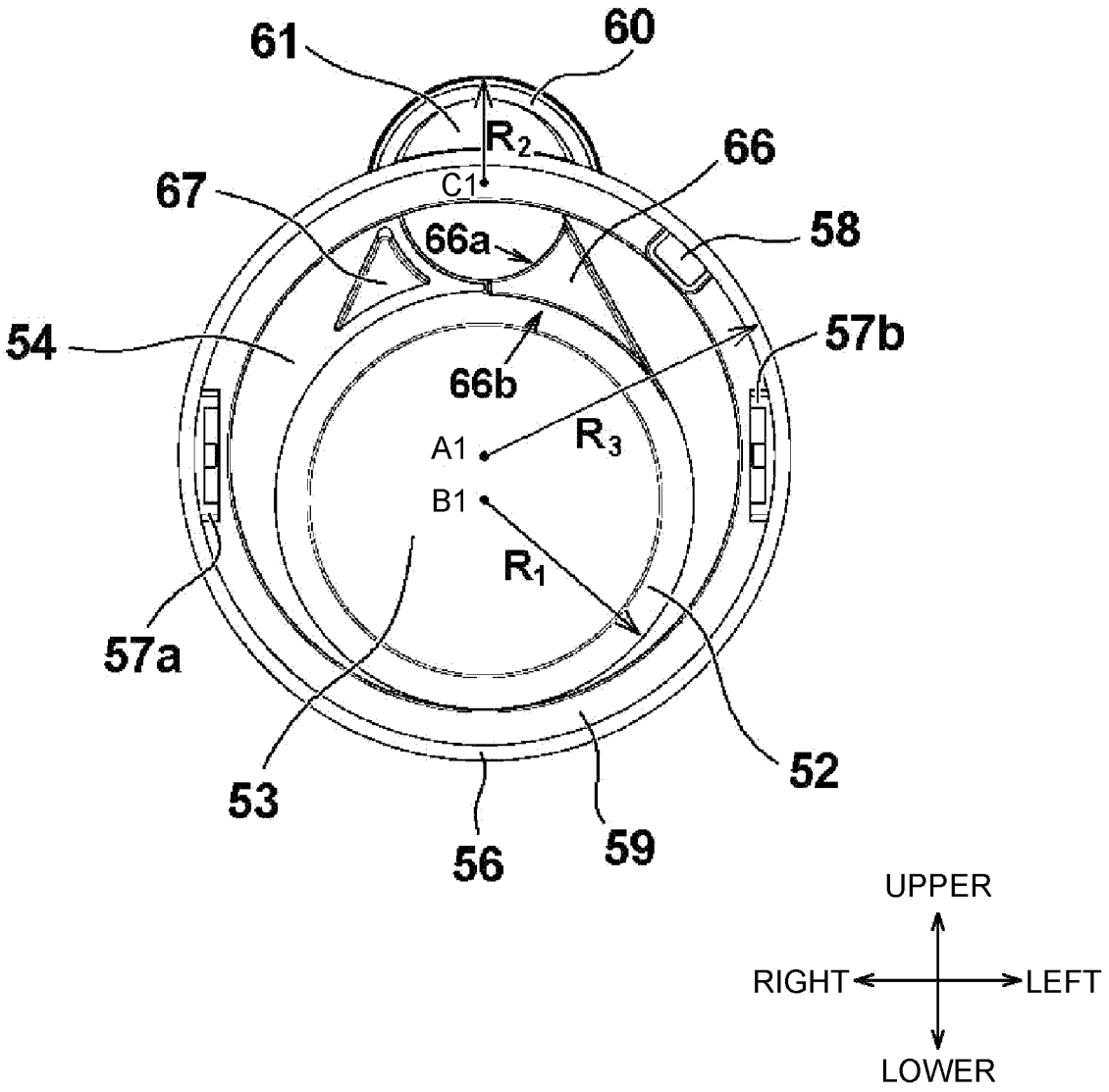
FIG. 7 is a rear view of a dust case 51 of FIG. 4.

FIG. 7 is a rear view of only the dust case 51 from a rear side (motor 21 side). As can be understood here, a diameter R1 of the outer cylindrical part 52 is formed to be sufficiently smaller than a diameter R3 of the cylindrical part 56. A diameter R2 of the connection pipe 60 is even smaller than the diameter R1 of the outer cylindrical part 52. In addition to the magnitude relation of the diameters R1, R2, and R3, the positional relationship is such that the cylindrical part 56 intersects the vicinity of the axial center C1 of the connection pipe 60 when viewed in a direction of the axis A1. On a portion outside the connection pipe 60 and the outer cylindrical part 52 and positioned inside the cylindrical part 56, a wall surface extending in a radial direction, that is, a connection wall 54 is formed. With such a shape, the dust case 51 can be easily manufactured by injection forming of a synthetic resin using two molds, and a rigidity of the dust case 51 after the forming can be increased.

Figure 8:
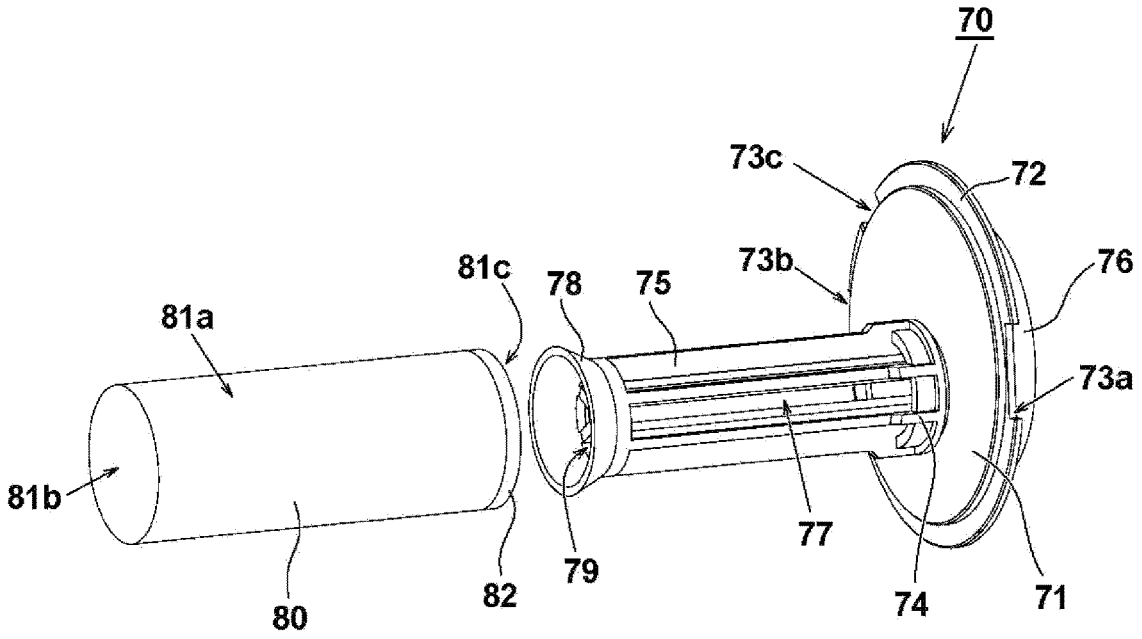
FIG. 8 is an exploded perspective view of a filter holder 70 and a filter 80 of FIG. 4.
Figure 9:
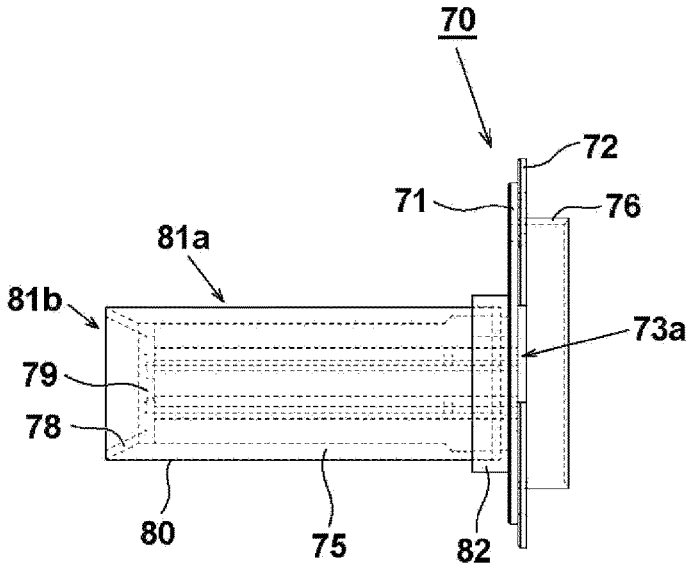
FIG. 9 is a side view illustrating a state in which the filter 80 is attached to the filter holder 70 of FIG. 4.

FIG. 8 is an exploded perspective view of the filter holder 70 and the filter 80, and FIG. 9 is a side view of the filter holder 70 with the filter 80 attached. The filter holder 70 serves the role of a lid for closing the outer cylindrical part 52 by the closed wall 71, and also serves the role of forming an inner cylindrical part to extend from the closed wall 71 to the inside of the outer cylindrical part 52 by the filter frames 75. The filter holder 70 is manufactured by integrally forming a synthetic resin. Inside the cyclone type cyclone chamber 53 (see FIG. 5), a cup-shaped filter 80 is positioned on an inner portion of the airflow AIR1 (see FIG. 2) rotating in the cyclone chamber 53, and air on an inner circumferential side which is lighter than dust moves inward in the radial direction through the filter 80. Large opening portions 77 are formed between the filter frames 75, and the opening portions 77 each have an elongated shape in the axial direction. The air that has reached the inside of the filter frames 75 through the filter 80 and the opening portions 77 is suctioned to the main body housing 10 side through the exhaust port 71*a* (see FIG. 4) formed in the vicinity of the center of the closed wall 71.

The filter 80 is formed in a cup shape with a nonwoven fabric made of several types of fibers having different thicknesses and can be manufactured using a known filter material available on the market. Also, the filter 80 can be easily attached to or removed from the filter holder 70. Six filter frames 75 are formed at regular intervals in the circumferential direction and are disposed to extend in the direction of the axis B1. Also, an enlarged diameter part 78 that extends in a conical shape is formed at front end portions of the filter frames 75, and an outer edge portion of the enlarged diameter part 78 is in contact with a joining portion between a cylindrical surface 81*a* and a bottom surface 81*b* of the filter 80, and thereby the filter 80 is stably held. An axial opening 79 is formed on an inner side of the enlarged diameter part 78 so that airflows in the direction of the axis B1. The cylindrical surface 81*a* and the bottom surface 81*b* of the filter 80 do not in contact with the filter frames 75, and only a part thereof is in contact with the enlarged diameter part 78. When the filter 80 and the filter frames 75 are not in close contact with each other in this way, an effective filtration area of the filter is increased, and thus filtration performance can be improved. A shrinkable attachment part 82 is formed in the vicinity of an outer edge of an opening 81*c* of the filter 80, and when the attachment part 82 is positioned on an outer circumferential side of a fixed rib 74, the attachment part 82 is stably held by the fixed rib 74 of the filter holder 70.

Figure 10:
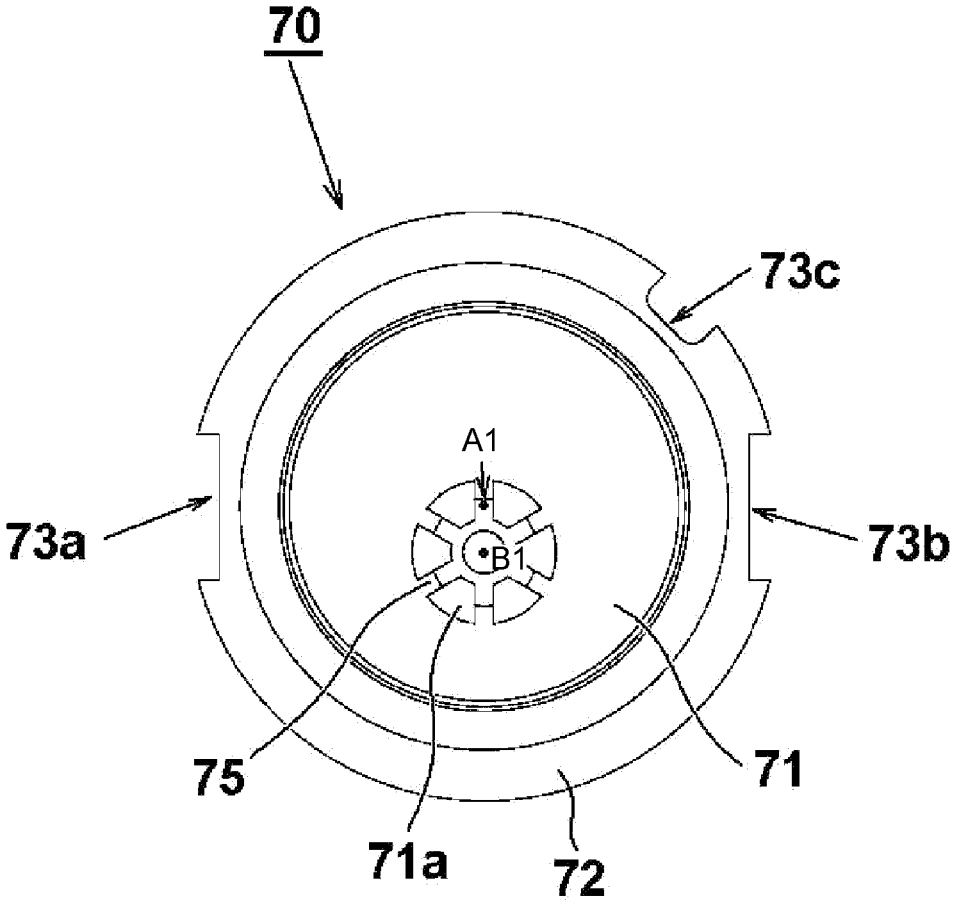
FIG. 10 is a rear view of the filter holder 70 of FIG. 4.

FIG. 10 is a rear view of the filter holder 70. Here, a cylindrical space due to the filter frames 75 is formed around the axis B1. The axis B1 is disposed to be shifted in one direction with respect to the rotation axis A1 for attaching the cyclone unit 50 to the main body housing 10. In other words, the rotation center (=axis B1) of the cyclone chamber 53 of the cyclone unit 50 is shifted from the attachment axis A1. The two notch parts 73*a* and 73*b* are provided on the flange part 72 of the filter holder 70 at rotationally symmetrical positions with the axial center A1 as a center. The notch parts 73*a* and 73*b* are formed to avoid interference with the protruding parts 57*a* and 57*b* when the filter holder 70 is attached to the dust case 51. Also, the notch part 73*c* for positioning in the circumferential direction when it is attached to the dust case 51 and stopping relative rotation of the dust case 51 and the filter holder 70 is formed in the vicinity of the notch part 73*b*.

Figure 11:
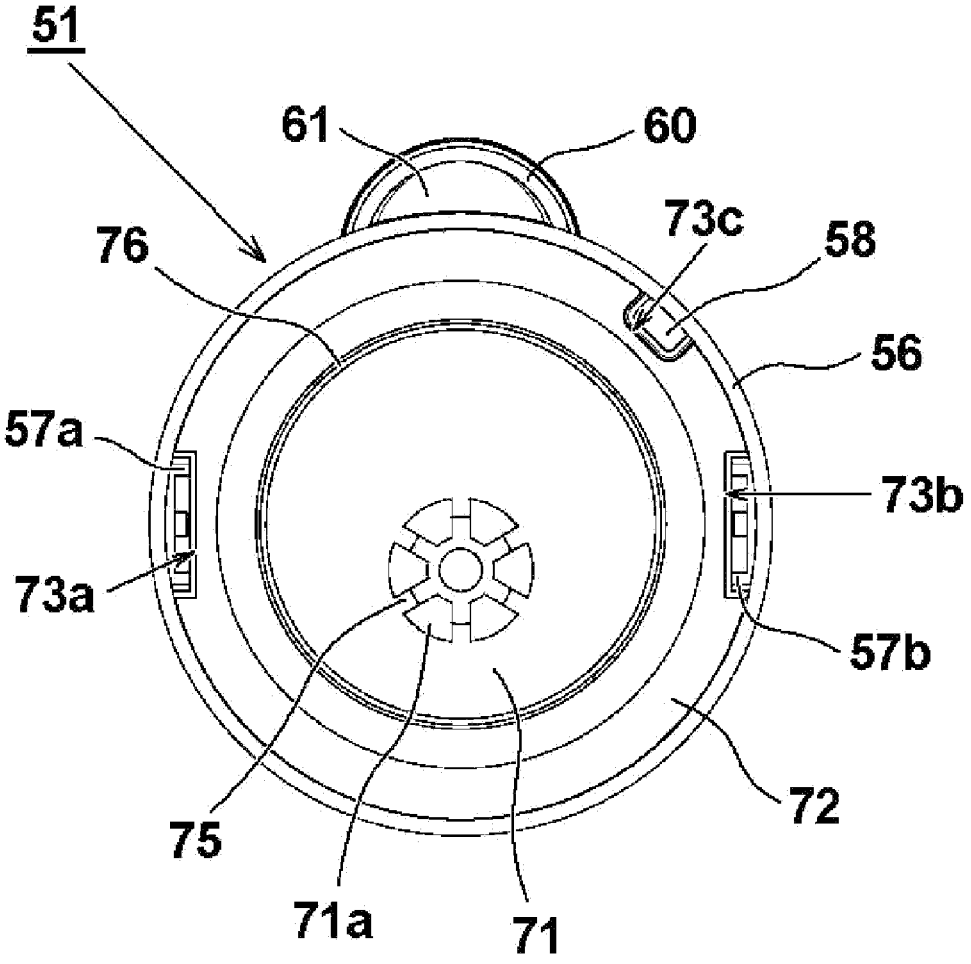
FIG. 11 is a rear view of the cyclone unit 50 of FIG. 1.

FIG. 11 is a rear view in a state in which the filter holder 70 is attached to the dust case 51 (rear view of the cyclone unit 50 in FIG. 1). The two protruding parts 57*a* and 57*b* and the one rotation restriction protruding part 58 are formed on an inner circumferential side of the cylindrical part 56 of the dust case 51. The rotation restriction protruding part 58 is a protrusion having a smaller circumferential length than the protruding parts 57*a* and 57*b* and formed at a position on a rear side of the protruding parts 57*a* and 57*b* in a direction of the axis A1 and is provided for aligning a circumferential position of the filter holder 70 with respect to the dust case 51. Therefore, when the filter holder 70 is attached, the cylindrical space due to the filter frames 75 is always positioned at a center of the outer cylindrical part 52. Also, the cylindrical space due to the filter frames 75 is offset downward as viewed from the axis A1 and is positioned on a side opposite to an upper side in which the connection pipe 60 is positioned. To attach the filter holder 70 to the dust case 51, the filter holder 70 is positioned so that the notch parts 73*a* to 73*c* are aligned with positions of the protruding parts 57*a* and 57*b* and the rotation restriction protruding part 58, and the filter holder 70 is moved to a side closer to the bottom surface 52*a* (see FIG. 6) in a direction of the axis A1 so that the flange part 72 of the filter holder 70 comes into contact with the stepped surface 59 (see FIG. 6) of the dust case 51. Thereafter, when the dust case 51 is attached to the main body housing 10, movement of the filter holder 70 in a front-rear direction is restricted by the cylindrical filter attachment part 36 (see FIG. 5) of the main body housing 10 and the stepped surface 59 (see FIG. 6).

Figure 12:
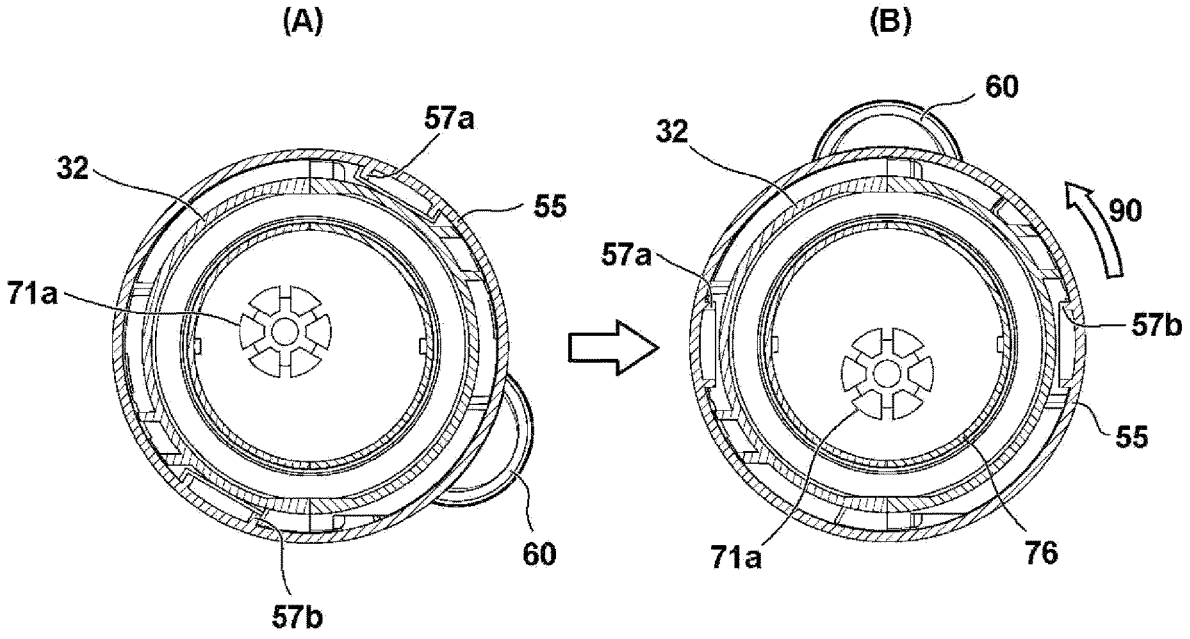
FIG. 12 is a view for explaining a method of attaching the cyclone unit 50 to the main body housing 10 in FIG. 1 and is a cross-sectional view along line B-B of FIG. 1.

FIG. 12 is a view for explaining a method of attaching the cyclone unit 50 to the main body housing 10 and is a cross-sectional view along line B-B of FIG. 1. In order to attach the cyclone unit 50 to the main body housing 10, the two protruding parts 57*a* and 57*b* are aligned to be positioned in the circumferential direction to face the axial grooves 31 of the main body housing 10 as illustrated in FIG. 12(A), in that state, the cyclone unit 50 is pressed against the main body housing 10 side and rotated counterclockwise as indicated by an arrow 90 when viewed from the rear in the direction of the axis A1 as illustrated in FIG. 12 (B), and the two protruding parts 57*a* and 57*b* are slid in the circumferential grooves 32 illustrated in FIG. 5 and rotated in a direction in which they approach the stopper surfaces 32*a*. A rotation angle of the arrow 90 at this time is about 120 degrees. Also, in such rotation, the connection pipe 60 is positioned either immediately above (state of FIG. 12) or immediately below (see FIG. 13). The two protruding parts 57*a* and 57*b* reach positions adjacent to or in contact with the stopper surfaces 32*a* in the circumferential grooves 32 illustrated in FIG. 5. The lock member 34 (see FIGS. 4, 5) is provided in the vicinity of the stopper surface 32*a* on a side surface on a front side in the axial direction, and thus a distance in the axial direction of the circumferential groove 32 is formed to be small. Due to such a shape of the circumferential groove 32, when the front side surfaces of the two protruding parts 57*a* and 57*b* come into contact with the lock members 34, the cyclone unit 50 is stably held by the main body housing 10 by a frictional force between the lock members 34 and the two protruding parts 57*a* and 57*b*.

Figure 13:
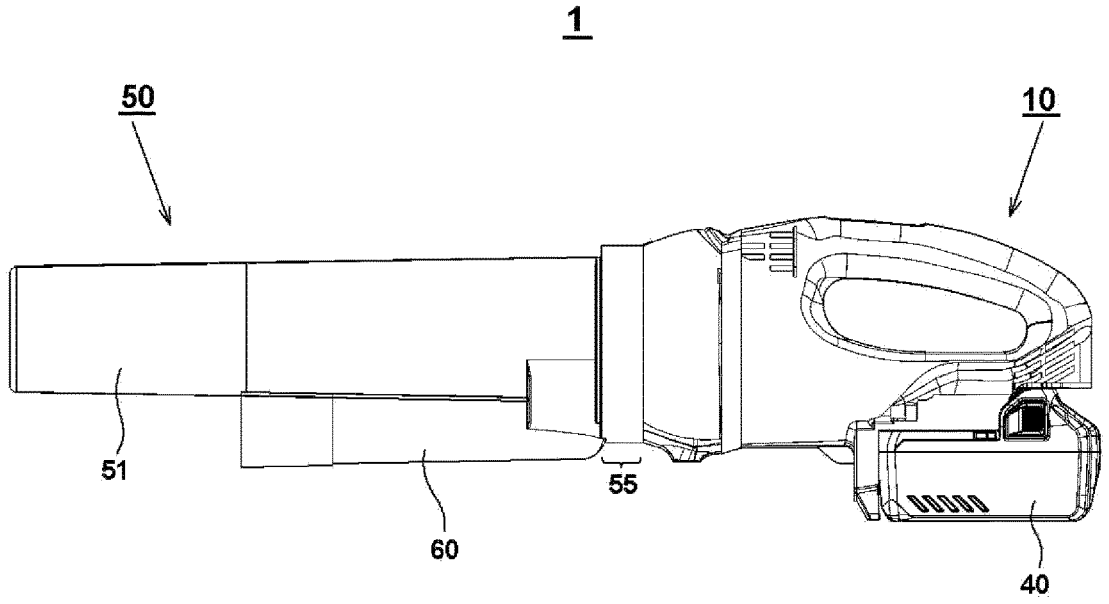
FIG. 13 is a view for explaining another method of attaching the cyclone unit 50 to the main body housing 10 in FIG. 1.

FIG. 13 is a view for explaining another method of attaching the cyclone unit 50 to the main body housing 10. In the cyclone unit 50 of the present example, the two protruding parts 57*a* and 57*b* are formed at positions separated by 180 degrees from each other on an inner side of the attachment part 55. That is, since the protruding parts 57*a* and 57*b* are disposed at positions rotationally symmetric with respect to the axis A1, an attachment method in which the connection pipe 60 is positioned on a lower side of the cyclone unit 50 is also possible as illustrated in FIG. 13 in addition to the attachment method in which the connection pipe 60 is positioned on an upper side of the cyclone unit 50 as illustrated in FIG. 1. When the cyclone unit 50 is attached to the main body housing 10 in this way, since an extension pipe or a nozzle (not illustrated) connected to a front side of the connection pipe 60 is positioned on the lower side of the main body housing 10, it is advantageous when a floor surface with a low height such as between a sofa and the floor is cleaned.

FIG. 14 is a perspective view of the filter filtration type vacuum cleaner 101 (with a dust case 151 removed). The dust collection unit 150 is constituted by the dust case 151 and the filter 160. In the vacuum cleaner 101, the main body housing 10 is common to the cyclone vacuum cleaner 1 illustrated in FIGS. 1 to 13. In the present example, the cyclone vacuum cleaner 1 and the normal vacuum cleaner 101 of a filter filtration type can be easily realized by attaching either the cyclone unit 50 (see FIG. 6) or the filter filtration type dust collection unit 150 to the common main body housing 10. In this way, when the main body housing 10 is made common to the filter filtration type vacuum cleaner 101 and a size of the cyclone unit 50 is made substantially the same as a size of the dust collection unit 150, a vacuum cleaner capable of realizing dual methods that are very easy for users to use while being compact and lightweight can be realized.

The filter 160 is attached to the main body housing 10 side. Therefore, as illustrated in FIG. 14, when the dust case 151 is removed from the main body housing 10, the filter 160 remains on the main body housing 10 side. The filter 160 is detachably attached to the main body housing 10. When the dust case 151 is removed, dust inside the dust case 151 and around the filter 160 can be dropped into a trash can, a trash bag, or the like.

The dust case 151 has a substantially cylindrical shape that is narrowed toward the front, and a pipe-shaped nozzle 152 is formed at a distal end in a direction of the axis A1. An opening of the nozzle 152 has a shape that is obliquely cut to be retracted downward. The nozzle 152 can be connected to a floor nozzle via an extension pipe (not illustrated) or directly to the floor nozzle. The filter 160 has a cup shape and includes a fine net 162 provided between frame parts 161 to filter dust in suctioned air. Here, the filter 160 is manufactured as an integrally formed product in which the frame parts 161 are formed of a synthetic resin by casting the net 162, but a shape of the filter 160 is not limited only to this, and the filter 160 may be realized by a known filter device formed of a cloth, paper, nonwoven fabrics, or the like. Although a bottom surface 163 (a surface perpendicular to the axis A1 and cannot be seen in the figure) on a distal end side (a side closer to the nozzle 152) of the filter 160 is closed, a net may also be disposed on the bottom surface 163 in the same manner.

Figure 15:
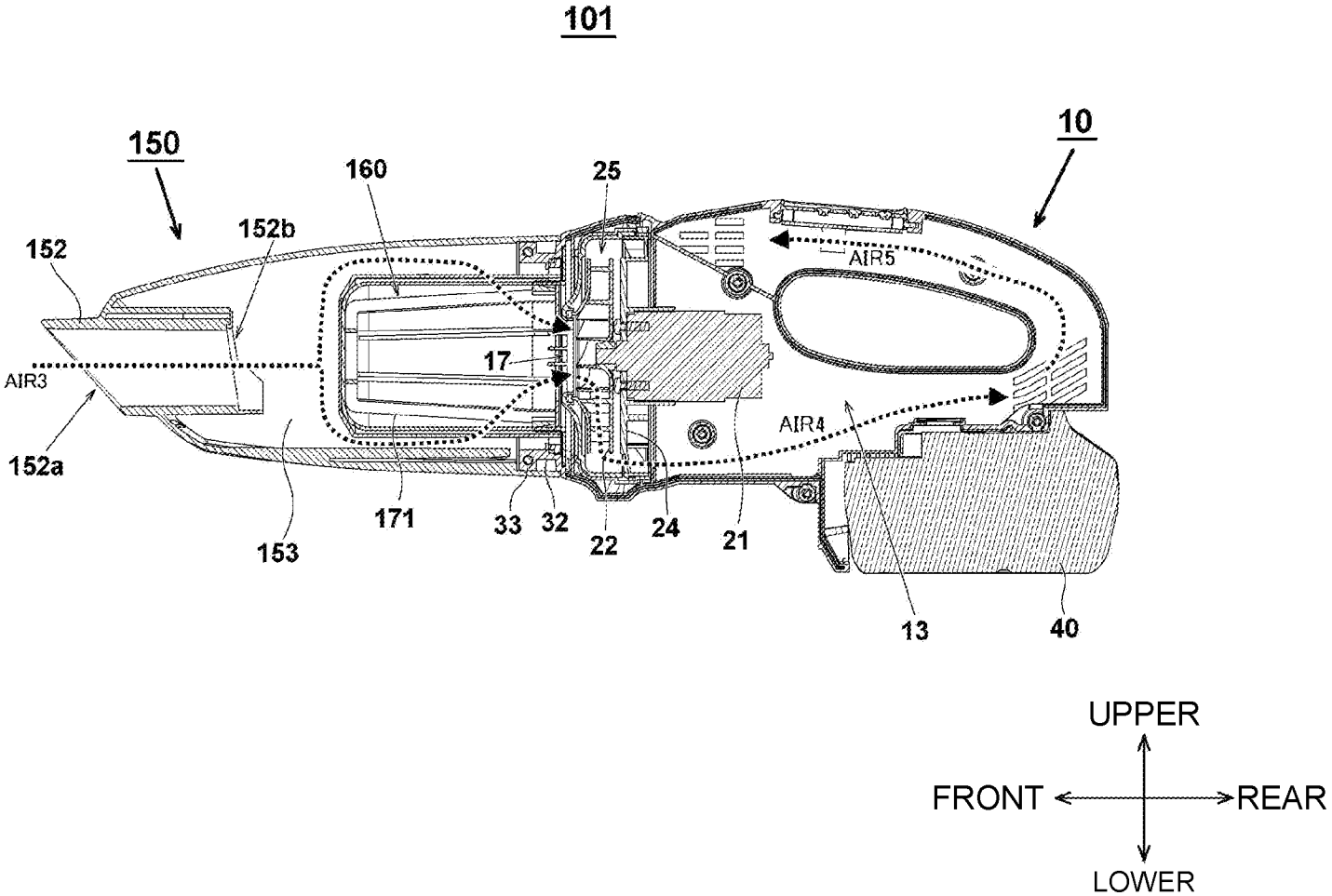
FIG. 15 is a longitudinal sectional view of the filter filtration type vacuum cleaner 101.

FIG. 15 is a longitudinal sectional view of the filter filtration type vacuum cleaner 101. As the motor 21 rotates, the fan 22 attached to a rotating shaft of the motor 21 rotates, and thereby air mixed with dust is suctioned from the nozzle 152. An opening/closing lid 152*b* made of rubber is provided at a rear end portion of the nozzle 152, and the opening/closing lid 152*b* is inclined rearward during suctioning to release a flow path of the nozzle 152. Air suctioned into the dust case 151 through the nozzle 152 flows from the outside to the inside of the filter 160, and at this time, only the dust is filtered by the net 162 (see FIG. 14), and the air that has reached the inside reaches the inside of the fan housing chamber 25 from the intake port 17 of the main body housing 10. The cup-shaped filter 160 is held by a filter holder 171 provided therein. The filter holder 171 is a cup-shaped inner frame made of synthetic resin and serves the role of maintaining a shape of the filter 160 that is deformed by the suctioned airflow. The air that has passed through the filter 160 passes through the intake port 17 and flows rearward to be suctioned into the fan housing chamber 25. A flow of the air suctioned into the fan housing chamber 25 is the same as the flow described in FIG. 2, and the air is discharged radially outward from the vicinity of the axis A1 by the fan 22, passes through an outer circumferential side of an outer cylindrical part of the motor holder 24 to flow rearward, and reaches the internal space 13 in which the motor 21 is housed.

Two protruding parts 157 are provided in the dust case 151. The protruding parts 157 have shapes common to the protruding parts 57*a* and 57*b* provided in the cyclone unit 50 of the cyclone vacuum cleaner 1 illustrated in FIGS. 1 to 13 and can be fixed to the attached part 30 of the main body housing 10 in the same manner as that.

An airflow AIR4 that has flowed to a rear side of the motor 21 is turned upward in its direction in the vicinity of a rear end of the handle part 14 as indicated by the dotted arrow, flows inside the handle part 14 from a rear side to a front side like an airflow AIR5, and is discharged to the outside from the first exhaust port 28. In the present example, since the second exhaust port 29 is also formed on a lower side of the rear end of the handle part 14, some of the airflow AIR4 is discharged from the second exhaust port 29, and the rest is discharged to the outside from the first exhaust port 28.

Figure 16:
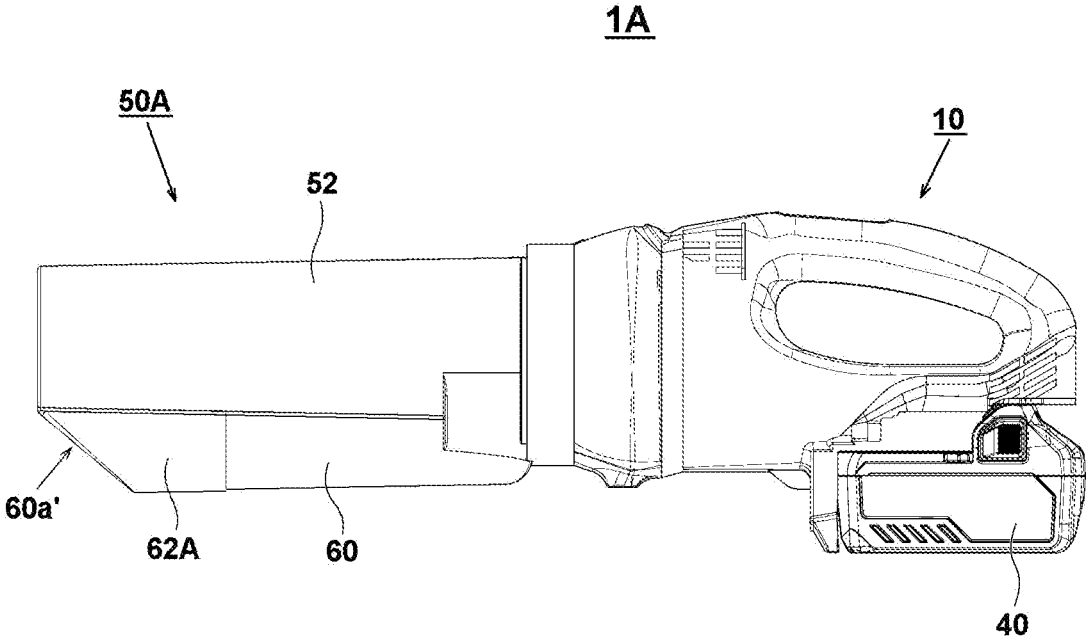
FIG. 16 is a side view of a cyclone vacuum cleaner 1A to which a cyclone unit 50A according to a modified example of the present invention is attached.

FIG. 16 is a side view of a cyclone vacuum cleaner 1A to which a cyclone unit 50A according to a modified example of the present invention is attached. The cyclone unit 50A is formed so that a connection pipe 60A and a connection part 62A are extended longer than those of the cyclone unit 50 illustrated in FIGS. 1 to 13, and a suction port 60*a*' that is an opening at a distal end of the connection part 62A is formed to be inclined. By forming as above, when the cyclone unit 50A is attached to the main body housing 10 so that the connection pipe 60A is positioned on the lower side as illustrated in FIG. 16, it is easy to perform suctioning work such as suctioning on a desk, cleaning a keyboard, or the like from the suction port 60*a*' in the state illustrated in FIG. 16 without using an extension pipe or an extension nozzle. Also, such a nozzle shape can realize the same usability as the conventional vacuum cleaner 101 illustrated in FIG. 14 and is very easy for user to use.

Figure 17:
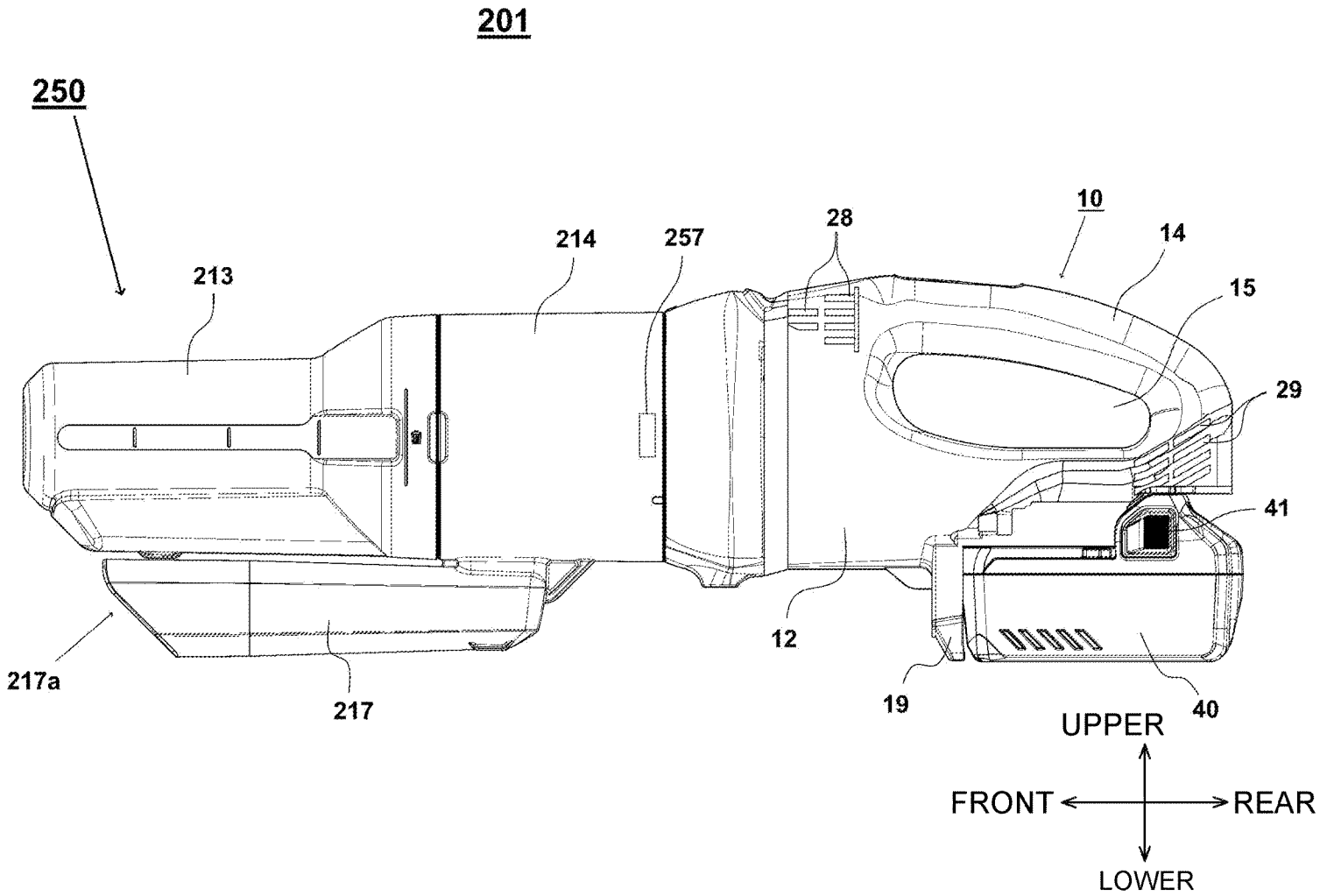
FIG. 17 is a side view of a two-stage cyclone vacuum cleaner 201.

FIG. 17 is a side view of the two-stage cyclone vacuum cleaner 201. A dust collection unit 250 is attached to the main body housing 10, and the main body housing 10 is common to the cyclone vacuum cleaner 1 illustrated in FIGS. 1 to 13, the vacuum cleaner 101 illustrated in FIGS. 14 and 15, and the cyclone vacuum cleaner 1A illustrated in FIG. 16.

Figure 18:
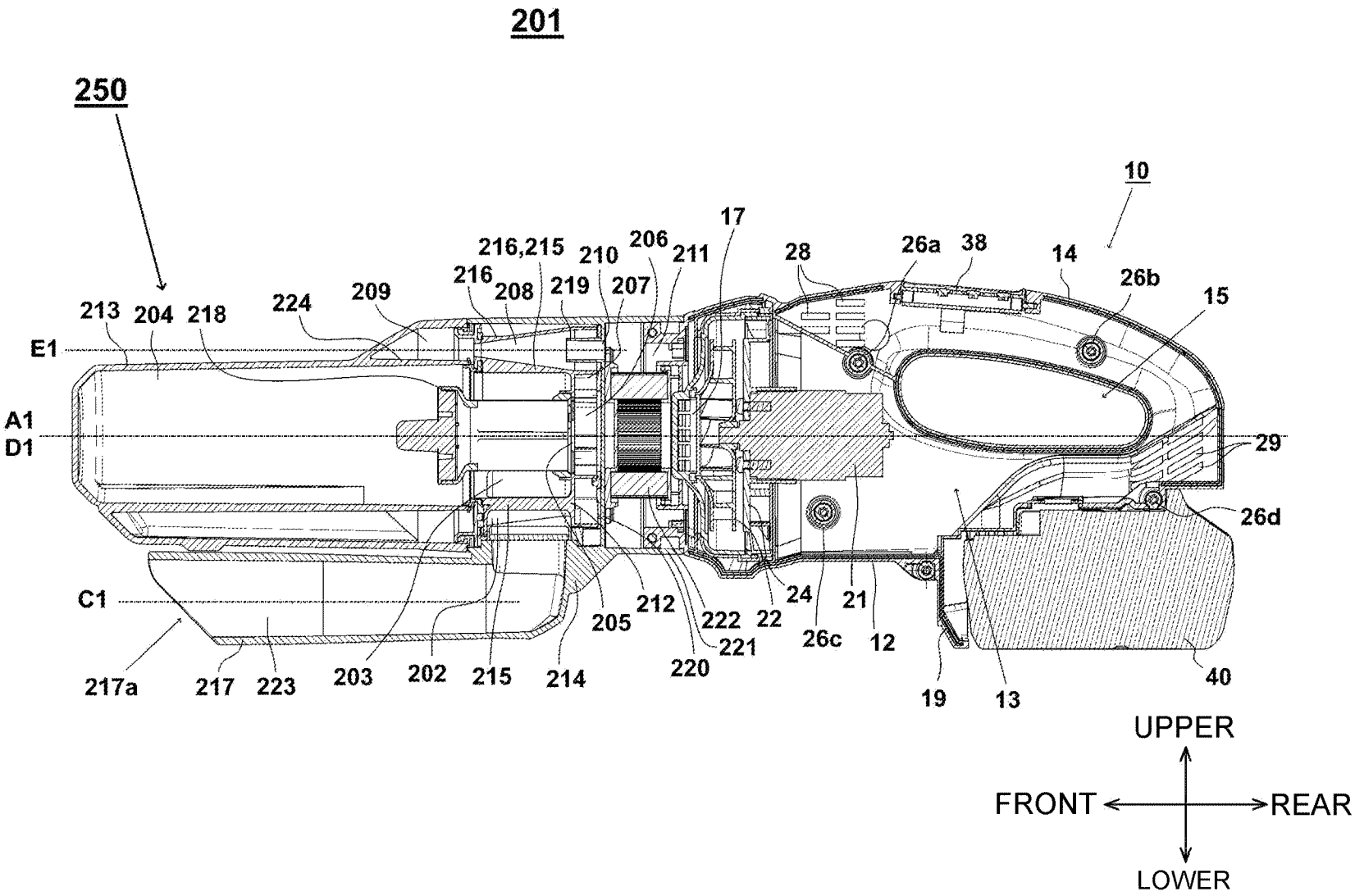
FIG. 18 is a vertical cross-sectional view of the two-stage cyclone vacuum cleaner 201.

FIG. 18 is a vertical cross-sectional view of the two-stage cyclone vacuum cleaner 201. The dust collection unit 250 includes a dust case 213, an intermediate case 214, and an inner case 212. A cylindrical connection pipe 217 extending in a front-rear direction is formed in the intermediate case 214, and the inside of the connection pipe 217 is configured as a connection passage 223. An extension pipe (not illustrated) can be connected to the connection pipe 217, and the extension pipe is common to the cyclone vacuum cleaner 1 illustrated in FIGS. 1 to 13, the vacuum cleaner 101 illustrated in FIGS. 14 and 15, and the cyclone vacuum cleaner 1A illustrated in FIG. 16. A rear end side of the connection pipe 217 is bent with respect to the front-rear direction.

The inner case 212 is attached to the inside of the intermediate case 214. The inner case 212 includes a cylindrical first outer cylinder 215 centered on an axis D1 extending in a front-rear direction, and one first cyclone chamber 203 is formed inside the first outer cylinder 215. The first outer cylinder 215 is connected to the connection pipe 217, and the first cyclone chamber 203 and the connection passage 223 communicate with each other through a first intake port 202. The dust case 213 is detachably coupled to the intermediate case 214 by a hinge (not illustrated) or the like. The dust case 213 is formed in a cylindrical shape with the rear end opened and the front end closed to extend in a direction of the axis D1, and a first dust collecting chamber 204 is formed therein. A rear end side of the first dust collecting chamber 204 is closed by the intermediate case 214, and the first dust collecting chamber 204 communicates with the first cyclone chamber 203. A cylindrical first exhaust duct 218 extending inside the first cyclone chamber 203 in a direction of the axis D1 is attached to the intermediate case 214. Further, the axis D1 is coaxial with the axis A1. A first exhaust port 205 provided on a rear side of the first exhaust duct 218 and opens to the inside of the first exhaust duct 218 to allow the inside and outside of the first cyclone chamber 203 to communicate is formed in the inner case 212. The inner case 212 forms a connection passage 206 connected to the first cyclone chamber 203 via the first exhaust port 205 at a position further rearward from the first exhaust port 205.

The inner case 212 includes a conical second outer cylinder 216 centered on an axis E1 parallel to the axis D1, and a second cyclone chamber 208 is formed inside the second outer cylinder 216. A plurality of the second outer cylinders 216 is disposed to be aligned in a circumferential direction with the axis D1 as the center, and thereby a plurality of (10 in the present example) second cyclone chambers 208 is formed. Each of the second outer cylinders 216 and the first outer cylinder 215 share a part of a wall part. A second intake port 207 that allows the inside and outside of the second cyclone chamber 208 to communicate is formed in the second outer cylinder 216, and the second cyclone chamber 208 and the connection passage 206 communicate with each other through the second intake port 207. A second dust collecting chamber 209 having an open rear end is formed in the dust case 213. The opening of the second dust collecting chamber 209 is closed by the intermediate case 214, and the second dust collecting chamber 209 communicates with the second cyclone chamber 208. Further, the first dust collecting chamber 204 and the second dust collecting chamber 209 are partitioned by a common partition wall 224. An opening is provided at a rear end of the second cyclone chamber 208, and the opening is closed by a partition wall 220 of the intermediate case 214 in contact with the rear end side. The partition wall 220 includes a cylindrical second exhaust duct 219 formed to extend in a direction of the axis E1 and a second exhaust port 210 provided in the partition wall 220 to allow the inside and outside of the second cyclone chamber 208 to communicate is formed inside the second exhaust duct 219.

The intermediate case 214 forms a filter chamber 211 by the partition wall 220 and a side wall 221. The filter chamber 211 opens at a rear end, and the opening is closed by the main body housing 10 when the intermediate case 214 is attached to the main body housing 10. A cylindrical filter 222 extending in a direction of the axis D1 is attached inside the filter chamber 211. The second exhaust port 210 opens into the filter chamber 211 on an outer circumferential side of the filter 222, and a space on an outer side of the filter 222 in the filter chamber 211 communicates with the second cyclone chamber 208 through the second exhaust port. A space on an inner side of the filter 222 communicates with the inside of the main body housing 10 via the intake port 17 of the main body housing 10.

A flow of air in the cyclone vacuum cleaner 201 will be described. When the motor 21 is driven, an airflow is generated by the fan 22. The airflow enters the connection passage 223 from a suction port 217*a*, passes through the connection pipe 217 and the first intake port 202, and enters the first cyclone chamber 203. The airflow swirls around the axis D1 in the first cyclone chamber 203 to centrifugally separate dust contained in the airflow. The dust moves forward while swirling and is stored in the first dust collecting chamber 204. The airflow enters the inside of the first exhaust duct 218 from the first cyclone chamber 203 and the first dust collecting chamber 204, and then proceeds to the first exhaust port 205, the connection passage 206, and the second intake port 207 in that order to enter the inside of the second cyclone chamber 208. The airflow swirls around the axis E1 in the second cyclone chamber 208 to centrifugally separate dust contained in the airflow. The dust moves forward while swirling and is stored in the second dust collecting chamber 209. The airflow enters the inside of the second exhaust duct 219 from the second cyclone chamber 208, then passes through the second exhaust port 210, and enters the space outside the filter 222 in the filter chamber 211. The airflow passes through the filter 222 from the outside toward the inside, and dust is separated by the filter 222 at this time. The airflow that has entered the inside of the filter 222 passes through the intake port 17, enters the inside of the main body housing 10, and heads for the fan 22.

Two protruding parts 257 are provided in the intermediate case 214. The protruding parts 257 have shapes common to the protruding parts 57*a* and 57*b* provided in the cyclone unit 50 of the cyclone vacuum cleaner 1 illustrated in FIGS. 1 to 13 and the protruding parts 157 provided in the dust case 151 of the vacuum cleaner 101 illustrated in FIGS. 14 and 15 and can be fixed to the attached part 30 of the main body housing 10 by the same method as those.

As described above, in the vacuum cleaner of the present example, since any one of the cyclone unit 50, the filter filtration type dust collection unit 150, and the cyclone unit 250 can be selected and attached to the main body housing 10, a one-stage cyclone vacuum cleaner, a two-stage cyclone vacuum cleaner, or a filter filtration type vacuum cleaner can be used in accordance with a collecting target of dust. Further, the present invention is not limited to the above-described examples, and various modifications can be made within a range not departing from the meaning of the present invention. For example, the filter filtration type dust collection unit 150 illustrated in FIGS. 14 and 15 has been described on the premise that a filter that is not frequently replaced is used on the rear side of the dust case 151, but it is also possible to use a so-called paper pack dust collecting type vacuum cleaner in which an attachment part for attaching a paper pack type filter is provided in the vicinity of the nozzle 152 of the dust case 151. In this case as well, a shape of the attachment part of the dust collection unit housing the paper pack may be a shape corresponding to the attached part 30 (see FIG. 5).

The invention claimed is:

1. A vacuum cleaner, comprising:

a motor;

a fan driven by the motor;

a main body housing housing the motor and the fan, and including an intake port and an attached part; and a cyclone unit detachably attached to the attached part of the main body housing to cover the intake port;

wherein the cyclone unit has:

a first attachment part configured to attach to the attached part;

a connection pipe having a suction port, at a front end, through which an airflow from outside enters, the connection pipe extending from the suction port to a side of the first attachment part;

a main case being a cylindrical shape, the main case including the first attachment part, and connected to the connection pipe;

wherein the main case includes:

a cyclone chamber having an inflow port communicating with the connection pipe, the cyclone chamber is a shape extending more toward a side of the suction port than the inflow port;

an inner cylindrical part which is provided in the cyclone chamber and is a cylindrical shape extending in an axial direction of the connection pipe, and through which the airflow flowing from the inflow port into the cyclone chamber passes toward the main body housing, wherein dust is centrifugally separated with the airflow swirling around a periphery of the inner cylindrical part inside the cyclone chamber to accumulate dust inside the cyclone chamber, wherein the cyclone unit is configured to be alternatively attachable to the attached part of the main body housing in a first state and a second state, wherein dust collection is performed in both the first state and the second state, wherein, in a direction intersecting the axial direction, the first state is which the connection pipe is disposed at one side of the cyclone chamber, and the second state is which that the connection pipe and the cyclone chamber being disposed in the same position relative to each other as the first state but in different positions relative to a fixed point on the main body housing, wherein the connection pipe maintains communication between the cyclone chamber and an outside of the main body in the first state and second state.

2. The vacuum cleaner according to claim 1, wherein the cyclone unit is configured to be attachable/detachable through rotation relative to the main body housing.

3. The vacuum cleaner according to claim 2, wherein, in the cyclone unit, a central axis (B1) of the cyclone chamber in the cylindrical shape is offset in a radial direction with respect to a central axis (A1) of a rotational operation in an attachment/detachment operation of the cyclone unit.

4. The vacuum cleaner according to claim 3, wherein, in the cyclone unit, the connection pipe is disposed on a side opposite to the central axis (B1) of the cyclone chamber with respect to the central axis (A1) of the rotational operation.

5. The vacuum cleaner according to claim 3, wherein the cyclone chamber of the cyclone unit is integrally formed of a synthetic resin, and the connection pipe is formed to protrude radially outward from a rotation range of the attached part in the rotational operation.

6. The vacuum cleaner according to claim 3, wherein a filter of the cyclone unit is positioned to cover the intake port of the main body housing, and the filter and the cyclone chamber each include a restriction means which makes rotation relative to each other impossible at a time of being attached to the main body housing.

7. The vacuum cleaner according to claim 6, wherein the filter has a cylindrical part protruding from the intake port to a side of the main body housing.

8. The vacuum cleaner according to claim 7, wherein, the attachment/detachment operation of the cyclone unit is configured to remove the cyclone chamber and the filter from the main body housing at a same time.

9. The vacuum cleaner according to claim 1, wherein the inner cylindrical part is configured to remain attached to the cyclone unit when the cyclone unit is removed from the main body housing.

10. The vacuum cleaner according to claim 2, wherein the cyclone unit has a cylindrical part provided with a protruding part protruding inward from an inner wall of the cylindrical part and configured to engage with the main body housing.

11. The vacuum cleaner according to claim 1, wherein the main case of the cyclone unit comprises an intermediate case, the intermediate case is configured to attach to the main body housing and has a filter inside, and a dust case forming the cyclone chamber is configured to attach to the intermediate case.

* * * * *